US009409406B2

(12) United States Patent
Kimura et al.

(10) Patent No.: US 9,409,406 B2
(45) Date of Patent: Aug. 9, 2016

(54) RECORDING APPARATUS WITH MOUNTING-REMOVING MECHANISM FOR INK CARTRIDGE

(71) Applicant: CANON KABUSHIKI KAISHA, Tokyo (JP)

(72) Inventors: Yukimichi Kimura, Kawasaki (JP); Koya Iwakura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/832,846

(22) Filed: Aug. 21, 2015

(65) Prior Publication Data

US 2016/0052284 A1 Feb. 25, 2016

(30) Foreign Application Priority Data

Aug. 25, 2014 (JP) ..... 2014-170983

(51) Int. Cl.
*B41J 2/175* (2006.01)

(52) U.S. Cl.
CPC ..... *B41J 2/1752* (2013.01)

(58) Field of Classification Search
CPC ..... B41J 2/175; B41J 2/17553; B41J 29/02; B41J 2/14; B41J 29/13; B41J 2/17503
See application file for complete search history.

(56) References Cited

U.S. PATENT DOCUMENTS 8,079,683 B2 * 12/2011 Silverbrook ..... B41J 2/1752 347/49
8,297,738 B1 * 10/2012 Kodama ..... B41J 2/1752 347/49
8,454,136 B2 * 6/2013 Katoh ..... B41J 2/17509 347/85

FOREIGN PATENT DOCUMENTS

JP 2008-110577 5/2008

* cited by examiner

*Primary Examiner* — Lamson Nguyen
(74) *Attorney, Agent, or Firm* — Canon USA Inc. IP Division

(57) ABSTRACT

A recording apparatus includes a recording head, an mounting portion on which an ink cartridge is mounted, a latching member configured to be movable between a first position where the latching member latches the ink cartridge mounted on the mounting portion and a second position where the latching member does not latch the ink cartridge mounted on the mounting portion, a regulation member configured to be movable between a regulating position where the regulation member regulates movement of the latching member and a regulation releasing position where the regulation member allows the movement of the latching member, and a return unit configured to return the regulation member to the regulating position from the regulation releasing position by contacting the regulation member moved to the regulation releasing position in order to allow the latching member to move to the second position.

20 Claims, 17 Drawing Sheets

RECORDING APPARATUS WITH MOUNTING-REMOVING MECHANISM FOR INK CARTRIDGE

BACKGROUND OF THE INVENTION

1. Field of the Invention

The present invention relates to a recording apparatus, and more particularly to an ink jet recording apparatus for executing recording by discharging ink onto a recording medium. More specifically, the present invention relates to a mounting-removing mechanism of an ink cartridge containing ink to be supplied to an ink jet recording head.

2. Description of the Related Art

An mounting-removing mechanism for mounting and removing an ink cartridge to and from a main body of an ink jet recording apparatus is discussed in Japanese Patent Application Laid-Open No. 2008-110577.

According to the technique discussed in Japanese Patent Application Laid-Open No. 2008-110577, the mounting-removing mechanism includes an operation lever, and a latching member provided on one end of the operation lever. An ink cartridge mounted on a cartridge mounting portion (hereinafter, simply referred to as "mounting portion") of the recording apparatus main body is latched by the latching member. Further, the operation lever is supported rotatably at the central portion thereof, and a user can release the engagement (latch) between the latching member and the ink cartridge to take out the ink cartridge from the mounting portion by operating (rotating) the operation lever.

According to the technique discussed in Japanese Patent Application Laid-Open No. 2008-110577, there remains a problem in which the operation lever is erroneously operated (i.e., erroneous operation) because of the carelessness of a user. In order to prevent the operation lever from being operated erroneously, a regulation member for further regulating the latched state of the latching member may be provided on the mounting-removing mechanism.

In other words, if the latched state of the latching member is regulated to "non-releasable" or "releasable" by the regulation member, the latched state of the latching member can be prevented from being released carelessly.

However, even if the regulation member is provided thereon, once the latched state of the latching member is switched to the releasable state by the regulation member, the latching member cannot automatically return to the non-releasable state from the releasable state unless the user operates the regulation member again.

Therefore, once the latched state of the latching member is switched to the releasable state by the regulation member, the latching member cannot easily return to the non-releasable state again, and thus the regulation member may not be able to operate the regulation function.

SUMMARY OF THE INVENTION

The present invention is directed to a recording apparatus capable of reducing a problem of an erroneous operation at a time of mounting or removing of an ink cartridge.

According to an aspect of the present invention, a recording apparatus includes a recording head configured to execute recording on a recording medium, a mounting portion on which an ink cartridge for supplying ink to the recording head is mounted, a latching member configured to be movable between a first position where the ink cartridge mounted on the mounting portion is latched and a second position where the ink cartridge mounted on the mounting portion is not latched, a regulation member configured to be movable between a regulating position where the regulation member regulates movement of the latching member and a regulation releasing position where the regulation member allows the movement of the latching member, and a return unit configured to return the regulation member to the regulating position from the regulation releasing position by contacting the regulation member moved to the regulation releasing position.

Further features of the present invention will become apparent from the following description of exemplary embodiments with reference to the attached drawings.

DESCRIPTION OF THE EMBODIMENTS

Hereinafter, a first exemplary embodiment of the present invention will be described with reference to FIGS. 1 to 11.

In the present exemplary embodiment, a serial type ink jet recording apparatus 10 (hereinafter, referred to as "recording apparatus") will be described as an example of the recording apparatus.

Figure 1:
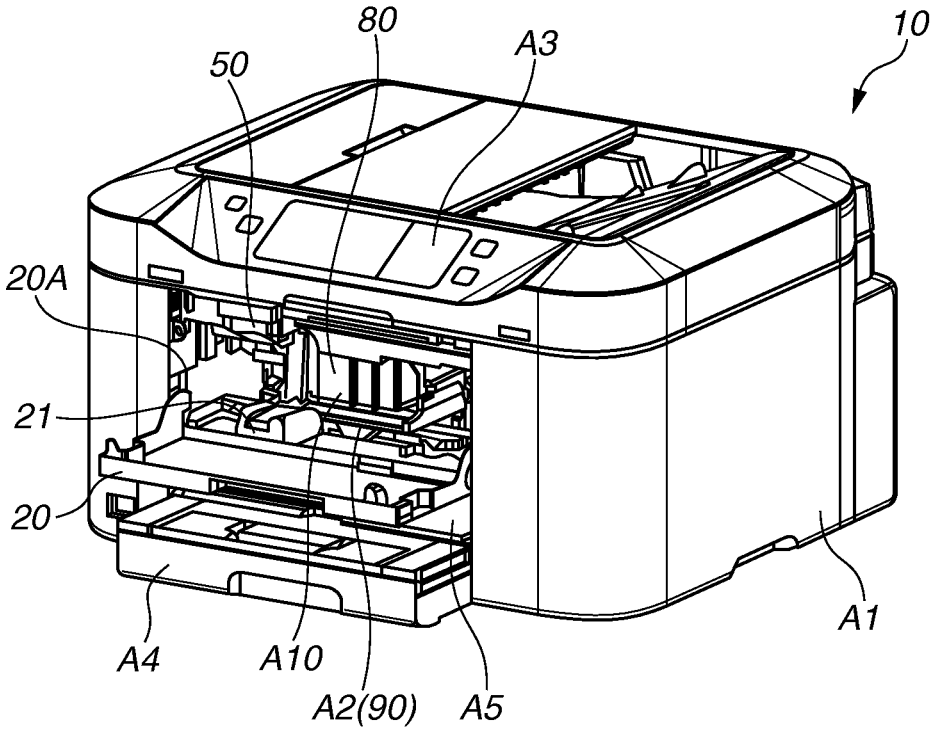
FIG. 1 is a perspective view illustrating a recording apparatus according to a first exemplary embodiment of the present invention.

FIG. 1 is a perspective (conceptual) view illustrating a recording apparatus according to the present exemplary embodiment.

As illustrated in FIG. 1, the recording apparatus 10 according to the present exemplary embodiment includes a housing (exterior portion) A1. A recording unit A2 and a mounting portion A10 are provided (housed) within the housing A1. The recording unit A2 includes a recording head 90 for executing recording mainly on a recording medium (not illustrated), and an ink cartridge 80 for supplying ink to the recording head 90 is mounted on the mounting portion A10.

In the present exemplary embodiment, the recording unit A2 and the mounting portion A10 are formed integrally, and the recording unit A2 is arranged at the bottom of the mounting portion A10.

Further, function units having respective functions, such as a sheet feeding unit, a conveyance unit, a maintenance unit, and a scanner unit, which are not illustrated in FIG. 1, are also arranged within the housing A1.

Further, an operation input unit A3 which allows a user to execute an operation such as inputting an instruction is provided on the upper portion of the housing A1. On the other hand, a sheet setting unit A4 for storing recording sheets, and a sheet discharge unit A5 for storing discharged recording sheet are provided on the lower portion of the housing A1.

An opening portion 20A which allows a user to perform replacement work of the ink cartridge 80 and an access cover 20 (door portion) capable of opening and closing the opening portion 20A are provided on a front face of the housing A1 facing the user.

A second lever 50 serving as a part of an operation lever unit 50L (latching unit) described below is provided on the opening portion 20A of the housing A1. When the user replaces the ink cartridge 80, the user can release and take out the ink cartridge 80 latched to the mounting portion A10 by operating the operation lever unit 50L.

Further, the housing A1 is provided with a guiding member 21. The guiding member 21 guides the ink cartridge 80 to be mounted on or removed from the mounting portion A10 and holds a posture of the ink cartridge 80 when the mounting-removing work is executed. The guiding member 21 is arranged on the front side of the ink cartridge 80, at a replacement position of the ink cartridge 80.

Further, the housing A1 is provided with a sensor (not illustrated) for detecting the opening or closing state of the access cover 20, and the sensor can output an opening/closing state detection signal to a control unit (micro processing unit (MPU) 201) described below in response to the opening or closing of the access cover 20.

Figure 2:
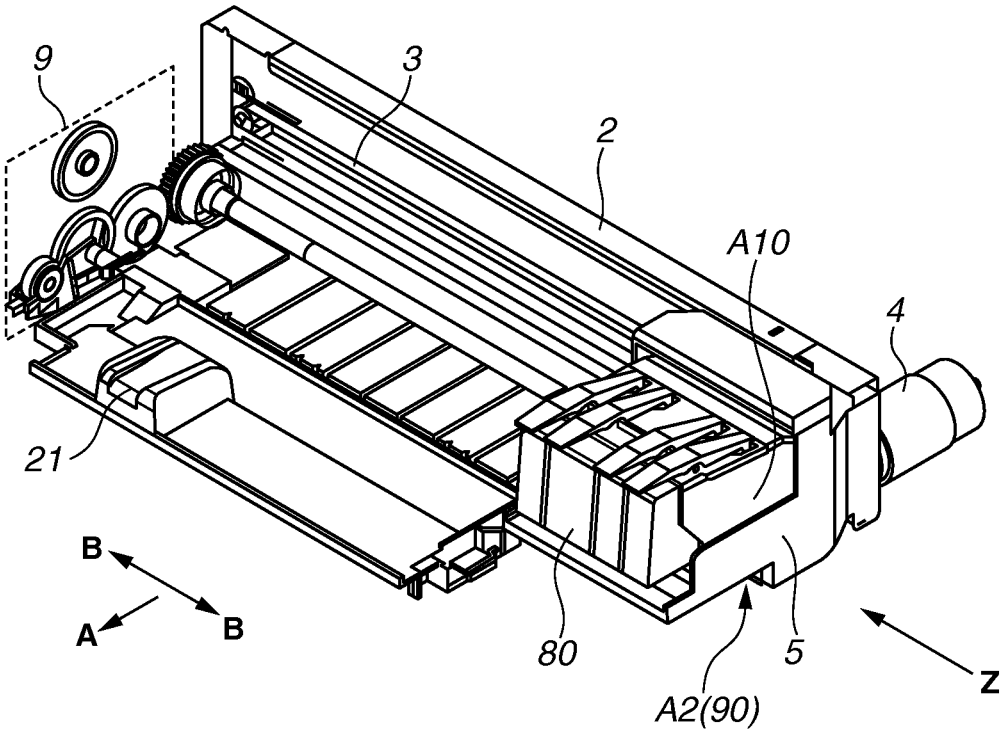
FIG. 2 is a perspective view illustrating an internal configuration of a main portion of the recording apparatus.

FIG. 2 is a perspective (conceptual) view illustrating an internal configuration of the main portion of the recording apparatus 10 according to the present exemplary embodiment.

As illustrated in FIG. 2, the mounting portion A10 of the ink cartridge 80 is detachably mounted to a carriage 5. Further, the recording unit A2 (recording head 90) provided at the bottom portion of the mounting portion A10 is arranged at a position opposite to the recording sheet.

The recording apparatus 10 further includes a main chassis 2, a timing belt 3, and a carriage motor 4. The carriage 5 receives a driving force from the carriage motor 4 via the timing belt 3, and moves in a scanning direction B orthogonal to a conveyance direction A of the recording medium while being supported by the main chassis 2. With this operation, the ink cartridge 80 and the recording head 90 mounted on the carriage 5 can reciprocally move in the scanning direction B together with the carriage 5.

The recording head 90 of the recording unit A2 discharges ink to record an image onto the recording medium based on image information. In addition, any recording medium may be used as long as the recording head 90 can form an image by landing ink droplets thereon. For example, recording media of various materials and forms, such as a paper sheet, a fabric surface, a label surface of an optical disk, a plastic sheet, an overhead projection (OHP) sheet, and an envelope may be used.

Further, a code strip (not illustrated) for detecting a position of the carriage 5 is stretched in parallel with the timing belt 3. For example, markings are formed on the code strip at pitches of 150 to 300 markings per inch. On the other hand, an encoder sensor (not illustrated) for reading the code strip is mounted on the carriage 5.

Further, the above-described maintenance unit is provided on the recording apparatus 10 at a position within a moving range of the carriage 5 in the scanning direction B. The maintenance unit is provided with a recovery unit (not illustrated) for executing recovery processing on the recording head 90, and arranged at a position facing a recording head discharge portion 93 described below.

Further, the recovery unit includes a cap portion (not illustrated) for capping a recording head discharge portion 93 and a suction mechanism (not illustrated) for removing residual bubbles and thickened ink within the recording head discharge portion 93 by forcibly sucking the ink in a capped state. Through the recovery processing executed by the recovery unit, functions of the recording head 90 are recovered while discharge characteristics thereof are maintained.

Further, in the present exemplary embodiment, the ink cartridges 80 in four colors (i.e., cyan, magenta, yellow, and black) is mounted on the mounting portion A10 and mounted on the carriage 5. In addition, the ink cartridges 80 in four colors are arranged in parallel with each other in the scanning direction B.

Further, a remaining ink amount detection unit (not illustrated) is provided on the recording unit A2, so that presence or absence of ink within the ink cartridge 80 can be detected. When the ink within the ink cartridge 80 is consumed and absence of the ink is detected by the remaining ink amount detection unit, the recording apparatus 10 notifies the user of absence of the ink through a display unit (operation input unit A3). The user can open the access cover 20 as illustrated in FIG. 1 to replace the ink cartridge 80 in response to the reception of the above notification.

As illustrated in FIG. 2, a driving force transmission portion 9 (connection means) described below is arranged at the left end portion of the main chassis 2, so that the driving force can be transmitted upward from below.

Figure 3A:
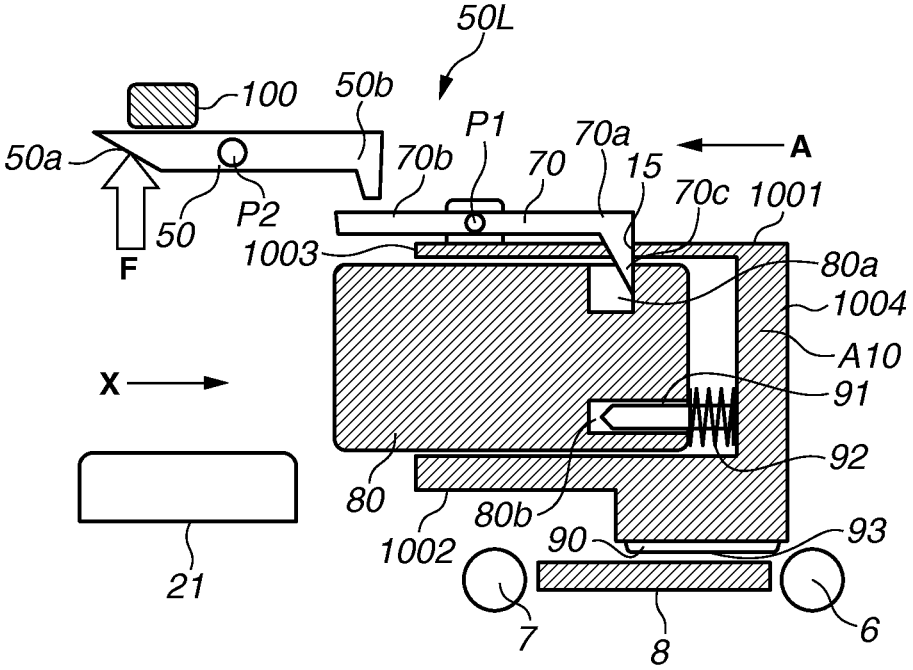
FIG. 3A is a cross-sectional view illustrating a state where an ink cartridge is mounted.
Figure 3B:
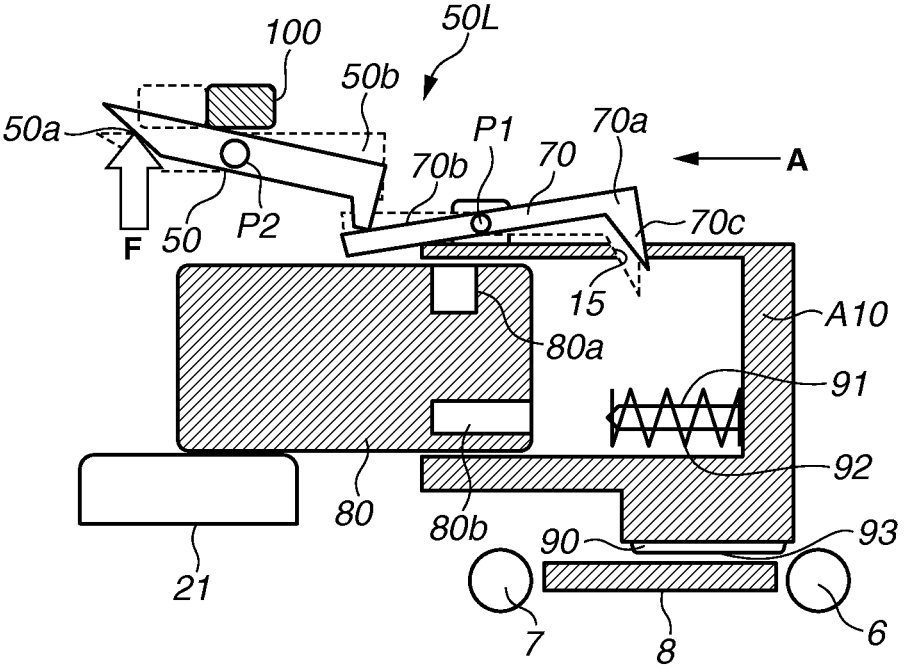
FIG. 3B is a cross-sectional view illustrating a state where the ink cartridge is released from the mounted state.

FIG. 3A is a cross-sectional (conceptual) view illustrating a state where the ink cartridge 80 is mounted. FIG. 3B is a cross-sectional (conceptual) view illustrating a state where the ink cartridge 80 is released from the mounted state. In addition, FIGS. 3A and 3B are vertical cross-sectional views seen along a direction Z in FIG. 2 when the ink cartridge 80 has moved to a position facing the guiding member 21.

As illustrated in FIG. 3A, the mounting portion A10 according to the present exemplary embodiment is mainly configured of an upper face portion 1001, a bottom face portion 1002, a mounting opening portion 1003, and a rear face portion 1004.

A through hole 15 through which a latching projection 70*c* of the operation lever unit 50L (latching unit) passes is formed on the upper face portion 1001.

A recording head joint portion 91 through which the ink can be supplied to the recording head 90 from the ink cartridge 80 is provided on the rear face portion 1004. The recording head joint portion 91 is inserted into an ink supply port 80*b* of the ink cartridge 80 mounted thereon along a mounting direction X. With the above-described configuration, an ink supply path from the mounting portion A10 to the recording head 90 is formed.

Further, an urging spring 92 that constantly generates urging force in a direction opposite to the mounting direction X is provided on the rear face portion 1004. When the ink cartridge 80 is mounted onto the mounting portion A10 through the mounting opening portion 1003, the urging spring 92 is compressed and the recording head joint portion 91 is inserted into the ink supply port 80*b*. Further, the latching projection 70*c* of the operation lever unit 50L (latching unit) maintains the state where the ink cartridge 80 is mounted (latched) onto the mounting portion A10.

Hereinafter, the latching unit according to the present exemplary embodiment will be described.

In the present exemplary embodiment, the operation lever unit 50L (latching unit) is mainly configured of a first lever 70 and a second lever 50.

More specifically, the first lever 70 is provided with a first end portion 70*a* and a second end portion 70*b*, and mounted on the upper face portion 1001 of the mounting portion A10 so as to be swingable about a fulcrum P1.

On the other hand, the second lever 50 is provided with a first end portion 50*a* and a second end portion 50*b*, and arranged in the vicinity of an upper end portion of the opening portion 20A of the housing A1 (see FIG. 1) so as to be swingable about a fulcrum P2.

The latching projection 70*c* is arranged on the first end portion 70*a* of the first lever 70. The latching projection 70*c* passes through the through hole 15 of the mounting portion A10 (i.e., upper face portion 1001) and enters an engagement depressed portion 80*a* of the ink cartridge 80 to form an engaged (latched) state at the first position. In other words, when the operation lever unit 50L is positioned at the first position, the latching projection 70*c* engages with the engagement depressed portion 80*a*, so that the ink cartridge 80 is latched to the mounting portion A10.

In addition, the first lever 70 is provided with an urging spring (not illustrated), so that the latching projection 70*c* is constantly urged downward. In other words, in the normal state, the operation lever unit 50L (latching unit) is constantly urged to move to the first position.

Further, when the ink cartridge 80 is replaced, the first lever 70 is moved to a replacement position by the carriage 5 together with the mounting portion A10, so that the second end portion 70*b* of the first lever 70 can be brought into contact with the second end portion 50*b* of the second lever 50. Therefore, as illustrated in FIG. 3B, when the ink cartridge 80 is removed, the first end portion 50*a* of the second lever 50 is pushed upward, so that the second end portion 50*b* is moved downward to press the second end portion 70*b* of the first lever 70 downward. Through the above operations, the latching projection 70*c* urged by the urging spring is moved upward against the urging force thereof, so that the engagement relationship between the latching projection 70*c* and the ink cartridge is released. Therefore, at this time, the latching projection 70*c* is moved to the second position where the latching projection 70*c* does not latch the ink cartridge 80.

After the latching projection 70*c* (operation lever unit 50L) has moved to the second position, the ink cartridge 80 is separated from the mounting portion A10 in a direction opposite to the mounting direction X because of the urging force of the urging spring 92.

As describe above, the operation lever unit 50L (latching unit) according to the present exemplary embodiment can move between the first position where the operation lever unit 50L latches the ink cartridge 80 mounted on the mounting portion A10 and the second position where the operation lever unit 50L does not latch the ink cartridge 80 mounted on the mounting portion A10. Further, the operation lever unit 50L can be moved to the second position from the first position through the user's operation.

Further, in the present exemplary embodiment, the latching projection 70*c* is moved to the second position from the first position when the user operates and pushes the first end portion 50*a* of the second lever 50 upward. However, the second lever 50 may be moved by, for example, another external force applied thereto from another urging force applying device.

Further, as illustrated in FIGS. 3A and 3B, a conveyance roller 6 and a sheet discharge roller 7 are driven by a conveyance motor (not illustrated) serving as a driving unit, so that a recording sheet (not illustrated) is conveyed in a conveyance direction A. Further, the recording head discharge portion 93 of the recording head 90 discharges ink to record an image onto the recording sheet conveyed into an image recording region on a platen 8. Then, the recording sheet on which the image is recorded is further conveyed in the conveyance direction A, and discharged outside the housing A1 via the sheet discharge unit A5 (see FIG. 1).

Hereinafter, a regulation member according to the present exemplary embodiment will be described.

Figure 4:
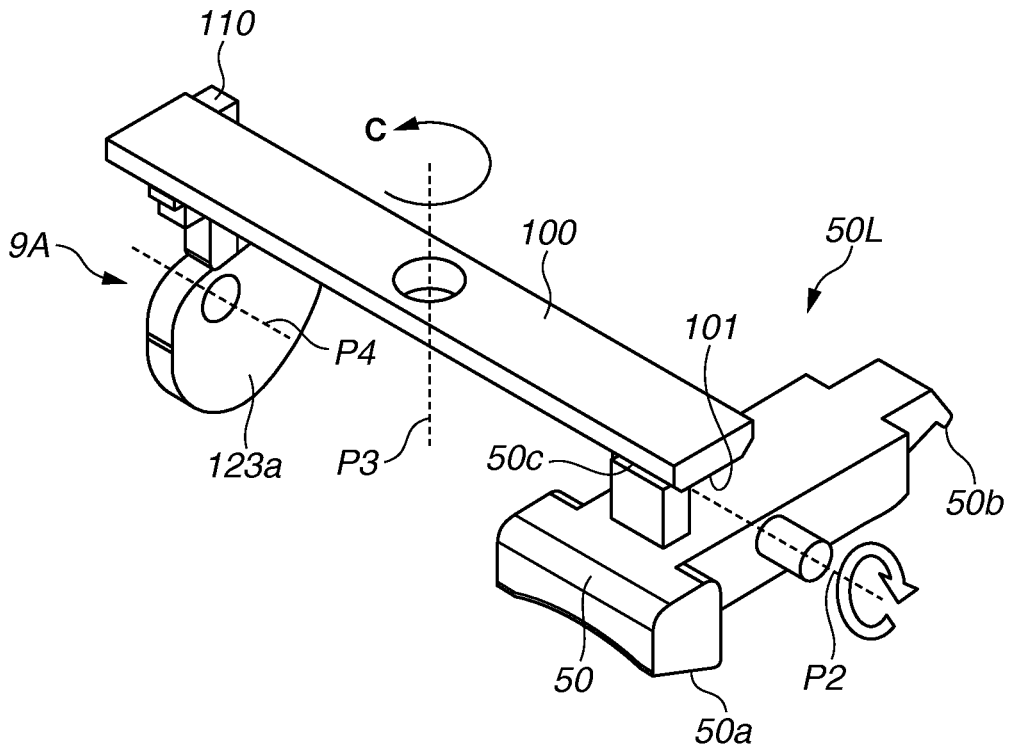
FIG. 4 is a perspective view illustrating a main portion of the recording apparatus.

FIG. 4 is a perspective (conceptual) view illustrating a main portion including a regulation member 100 of the recording apparatus 10 according to the present exemplary embodiment.

As illustrated in FIG. 4, the regulation member 100 is arranged on the upper side of the second lever 50 so as to be able to contact an abutting portion 50*c* formed on an upper face of the second lever 50.

More specifically, the regulation member 100 is attached to the housing A1 so as to be rotatable horizontally (swingable) about a fulcrum P3. Further, an urging member (not illustrated) urges a regulation end portion 101 (one end portion of the regulation member 100) to position on the upper side (i.e., regulating position) of the abutting portion 50*c* of the second lever 50, so that the movement of the abutting portion 50*c* in the upward direction is regulated by the regulation end portion 101. In other words, in the normal state, the regulation member 100 is urged by the urging member in a direction opposite to a rotation direction C, and positioned in the regulating position.

On the other hand, when the regulation member 100 rotates about the fulcrum P3, the regulation end portion 101 is moved to the regulation releasing position from the regulating position to permit the movement of the abutting portion 50*c* in the upward direction. In other words, the regulation member 100 can move to the regulating position where the regulation member 100 regulates the movement of the operation lever unit 50L (latching unit) and the regulation releasing position where the regulation member 100 permits the movement of the operation lever unit 50L.

As described above, when the regulation member 100 positioned at the regulating position, the movement (swing) of the second lever 50 about the fulcrum P2 in the upward direction is regulated thereby, and thus the first lever 70 (latching projection 70*c*) interlocking with the second lever 50 is maintained (locked) at the first position in the engaged state. Therefore, the operation lever unit 50L that latches the ink cartridge 80 is set to be a "regulated state", so that the engaged (mounted) state thereof will not be released by the erroneous operation executed by the user.

On the other hand, when the above-described "regulated state" has to be released, the regulation member 100 is rotated in the rotation direction C by a regulation releasing position moving unit described below, so that the regulation member 100 can be moved to the regulation releasing position from the regulating position. For example, as illustrated in FIG. 3B, if the regulation member 100 is moved to the regulation releasing position (indicated by a solid line) where the regulation member 100 allows the movement of the first end portion 50*a* from the regulating position (indicated by a dotted line) where the regulation member 100 regulates the first end portion 50*a*, the latched state of the ink cartridge 80 can be released by operating the operation lever unit 50L.

Furthermore, as illustrated in FIGS. 3A and 3B, in the present exemplary embodiment, the regulation member 100 is arranged on the upper side of the second lever 50 against the user's operation in an operation direction F. However, the regulation member 100 may be arranged in another position as long as the regulation member 100 can counteract the user's operation acting in an operation direction thereof. For example, if the user's operation direction for pushing the first end portion 50*a* of the second lever 50 is the top-to-bottom direction, the regulation member 100 may be arranged on the lower side of the first end portion 50*a*.

Hereinafter, the regulation releasing position moving unit that moves the regulation member 100 to the regulation releasing position from the regulating position to release the regulated state of the operation lever unit 50L will be described.

The regulation releasing position moving unit according to the present exemplary embodiment includes the driving force transmission portion 9 (connection unit) illustrated in FIG. 2 and a moving unit 9A illustrated in FIG. 4.

Figure 5A:
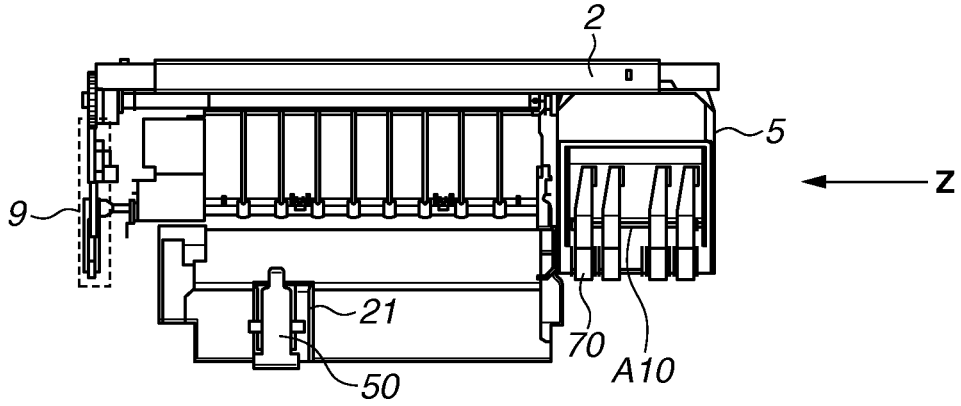
FIG. 5A is a top plan view of a carriage at a driving force non-transmittable position before moving to a driving force transmittable position.
Figure 5B:
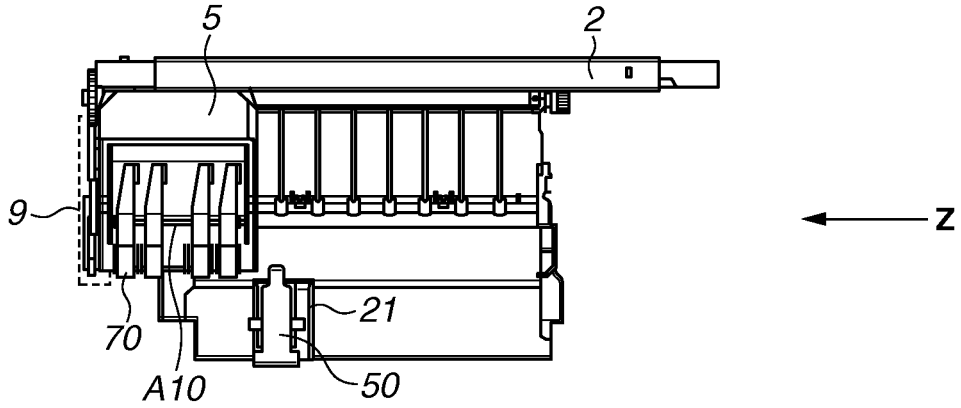
FIG. 5B is a top plan view of the carriage at the driving force transmittable position.
Figure 5C:
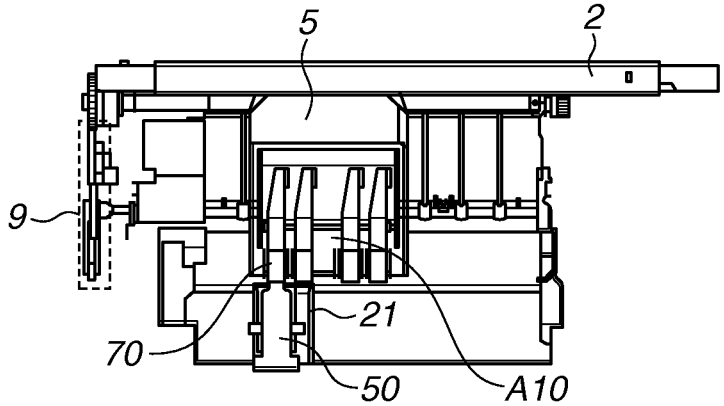
FIG. 5C is a top plan view of the carriage moved to an ink cartridge replacement position from the driving force transmittable position.

First, a driving force connection operation performed by the driving force transmission portion 9 will be described with reference to FIGS. 5A to 5C. Specifically, FIG. 5A is a top plan (conceptual) view of the carriage 5 in a driving force non-transmittable position before moving to a driving force transmittable position. FIG. 5B is a top plan (conceptual) view of the carriage 5 in the driving force transmittable position. FIG. 5C is a top plan (conceptual) view of the carriage 5 moved to an ink cartridge replacement position from the driving force transmittable position.

As illustrated in FIGS. 5A to 5C, in a case where the regulated state has to be released, an instruction for releasing the regulated state is input to the recording apparatus 10, so that the carriage 5 on which the mounting portion A10 is mounted moves from a normal recording region to the left end portion of the main chassis 2 where the driving force transmission portion 9 is arranged. In other words, the carriage 5 moves to a position where the driving force is transmitted thereto from a position where the driving force is not transmitted thereto.

Further, after the carriage 5 makes contact with the driving force transmission portion 9 arranged on the left end portion of the main chassis 2, the carriage 5 moves to the right again and stops at the replacement position of the ink cartridge 80, i.e., a position opposing the guiding member 21. In addition, a driving force is transmitted to the moving unit 9A via the driving force transmission portion 9 at the left end portion thereof.

Hereinafter, the driving force transmission portion 9 will be described in detail with reference to the cross-sectional views in FIGS. 6A to 6C.

Figure 6A:
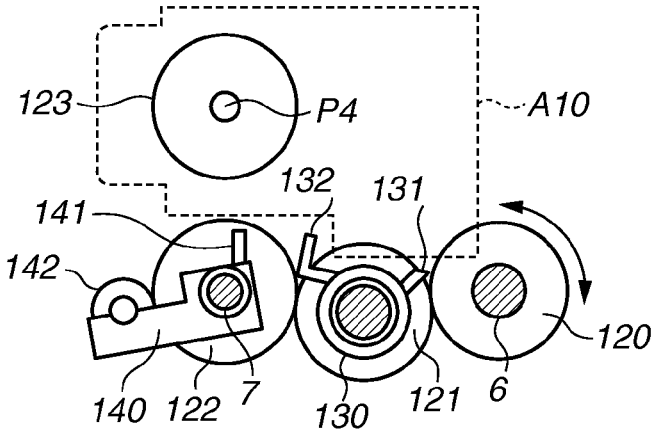
FIGS. 6A to 6C are cross-sectional views illustrating first to third states of a driving force transmission portion at the driving force non-transmittable position.
Figure 6B:
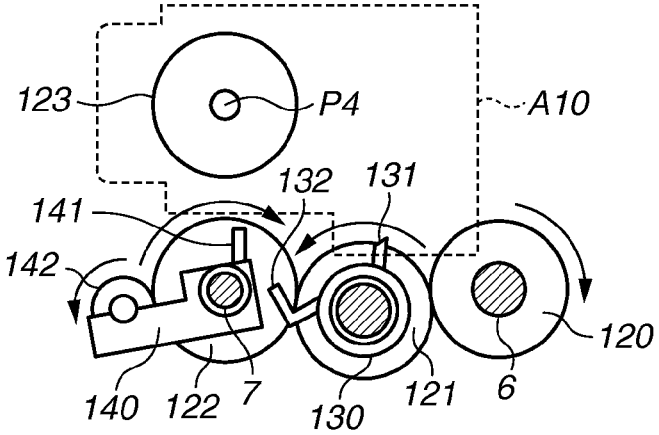
Figure 6C:
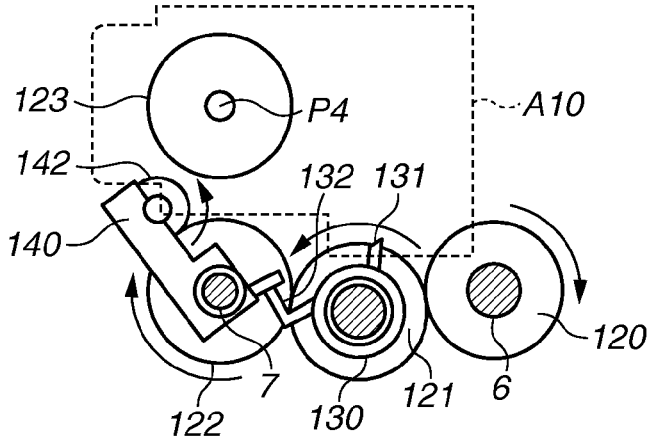

FIGS. 6A to 6C are cross-sectional (conceptual) views illustrating first to third states of the driving force transmission portion 9 at the driving force non-transmittable position illustrated in FIG. 5A. In addition, FIGS. 6A to 6C are vertical cross-sectional views seen in the direction Z in FIG. 5A. Further, the mounting portion A10 is indicated by a dotted line as a reference although the mounting portion A10 does not exist in this cross-sectional view.

As illustrated in FIG. 6A, the driving force transmission portion 9 is mainly configured of a conveyance roller gear 120, an idler gear 121, and a sheet discharge roller gear 122. The conveyance roller gear 120 and the conveyance roller 6 are arranged in a coaxially rotatable state. Further, the sheet discharge roller gear 122 and the sheet discharge roller 7 are arranged in a coaxially rotatable state.

The conveyance roller 6 can rotate in a normal direction as well as in a reverse direction. When the conveyance roller 6 rotates, the idler gear 121 also rotates along with the rotation of the conveyance roller gear 120 rotating together with the conveyance roller 6.

The rotating idler gear 121 causes the sheet discharge roller 7 to rotate via the sheet discharge roller gear 122 rotating together with the sheet discharge roller 7. In addition, the conveyance roller 6 and the sheet discharge roller 7 rotate in the same direction.

A trigger member 130 is provided on the idler gear 121, and the trigger member 130 can rotate in a rotation direction according to the rotation direction of the idler gear 120. The rotation amount of the trigger member 130 is regulated by a regulation member (not illustrated).

The idler gear 121 includes a carriage abutting portion 131 and a pendulum abutting portion 132. The sheet discharge roller 7 is provided with a pendulum portion 140, and the pendulum portion 140 can rotate in a rotation direction according to the rotation direction of the sheet discharge roller 7. The rotation amount of the pendulum portion 140 is also regulated by a regulation member (not illustrated).

Further, the pendulum portion 140 includes a trigger abutting plane 141 that latches the pendulum abutting portion 132. Further, the pendulum portion 140 includes a planet gear 142 engageable with a gear 123, so that the driving force for moving the regulation member 100 can be transmitted thereto through the gear 123.

As illustrated in FIG. 6B, when the conveyance roller 6 rotates in the reverse rotation direction, the idler gear 121 rotates in the normal rotation direction. Along with the rotation of the idler gear 121, the trigger member 130 also moves in the normal rotation direction until the regulation member (not illustrated) regulates the movement thereof. At this time, the sheet discharge roller 7 rotates in the reverse rotation direction and the planet gear 142 rotates in the normal rotation direction, so that the pendulum portion 140 starts rotating in the reverse rotation direction.

As illustrated in FIG. 6C, after the pendulum portion 140 starts rotating in the reverse rotation direction, the trigger abutting plane 141 abuts against the pendulum abutting portion 132. At this time, the pendulum portion 140 cannot rotate in the reverse rotation direction, and the planet gear 142 and the gear 123 are not engaged to but separated from each other. Therefore, the driving force is not transmitted to the gear 123.

Figure 7A:
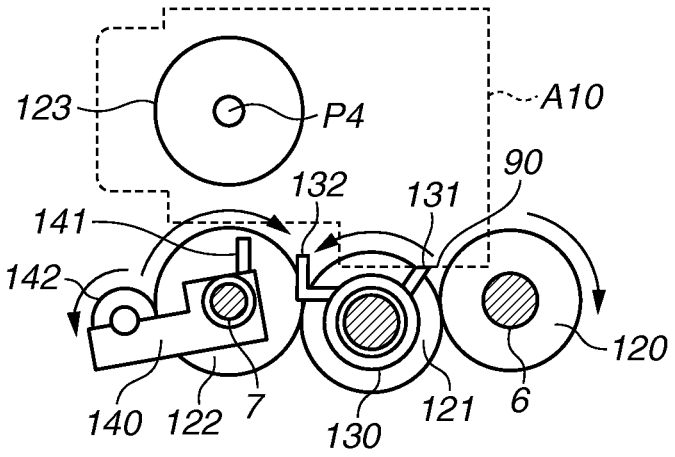
FIGS. 7A and 7B are cross-sectional views illustrating first and second states of the driving force transmission portion at the driving force transmittable position.
Figure 7B:
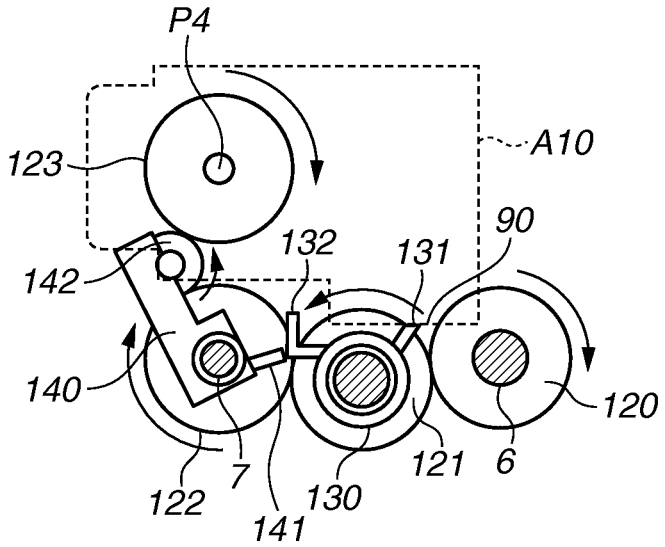

FIGS. 7A and 7B are cross-sectional (conceptual) views illustrating first and second states of the driving force transmission portion 9 at the driving force transmittable position illustrated in FIG. 5B. In addition, FIGS. 7A and 7B are vertical cross-sectional views seen along the direction Z illustrated in FIG. 5B. Further, the mounting portion A10 is indicated by a dashed line.

As illustrated in FIG. 7A, the trigger member 130 moves in the normal rotation direction so that the carriage abutting portion 131 abuts against the recording head 90. Therefore, the trigger member 130 and the pendulum abutting portion 132 cannot rotate any more.

Further, as illustrated in FIG. 7B, when the pendulum portion 140 rotates in the reverse rotation direction, the pendulum abutting portion 132 is located at a position where the trigger abutting plane 141 does not abut against the pendulum abutting portion 132. Therefore, the pendulum portion 140 can rotates in the reverse rotation direction up to a point where the planet gear 142 is engaged with the gear 123.

Further, the engaged gear 123 can be rotated in the reverse rotation direction by the planet gear 142, so that the driving force is transmitted upward from below.

As described above, unless the carriage 5 is located at a position illustrated in FIG. 5B, the driving force of the driving force transmission portion 9 is not transmitted to the below-described moving unit 9A (see FIG. 4), so that the regulation member 100 cannot be moved via the moving unit 9A.

In other words, when the carriage 5 performs a normal printing or a recovery processing (i.e., moved in a normal region), the regulation member 100 constantly regulates the operation lever unit 50L, and thus the user cannot take out (replace) the ink cartridge 80.

Subsequently, description will be given to the moving unit 9A that makes contact with the regulation member 100 to move the regulation member 100 to the regulation releasing position from the regulating position.

As illustrated in FIG. 4, the moving unit 9A is configured of a cam 123*a* coaxially rotatable about a fulcrum P4 together with the gear 123 (see FIG. 7B) of the driving force transmission portion 9 and a regulation release member 110 capable of moving in the vertical direction along with the rotation of the cam 123*a*.

The regulation member 100 can move in a rotation direction C when the regulation release member 110 pushes the regulation member upward. The regulation release member 110 is constantly urged in a downward direction by the force applied thereto from an urging means (not illustrated).

Next, an operation for moving the regulation member 100 to the regulation releasing position from the regulating position will be described.

Figure 8A:
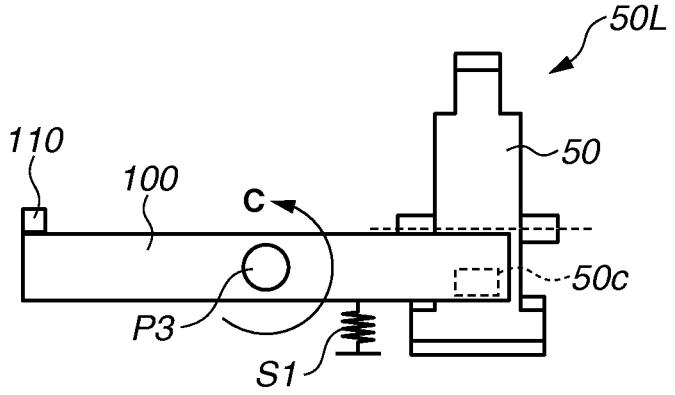
FIGS. 8A to 8C are top plan views illustrating first to third states of the main portion of the recording apparatus.
Figure 8B:
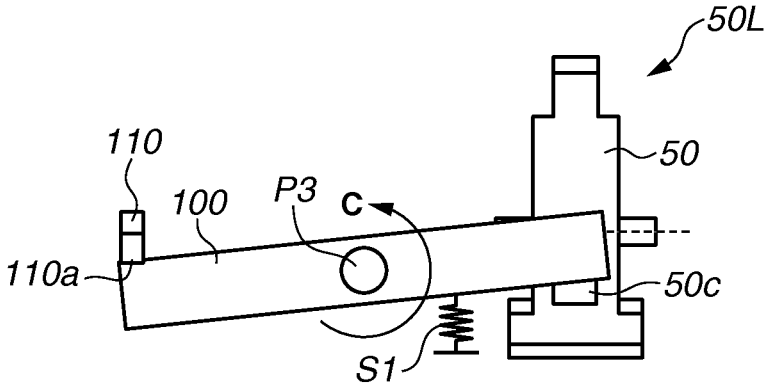
Figure 8C:
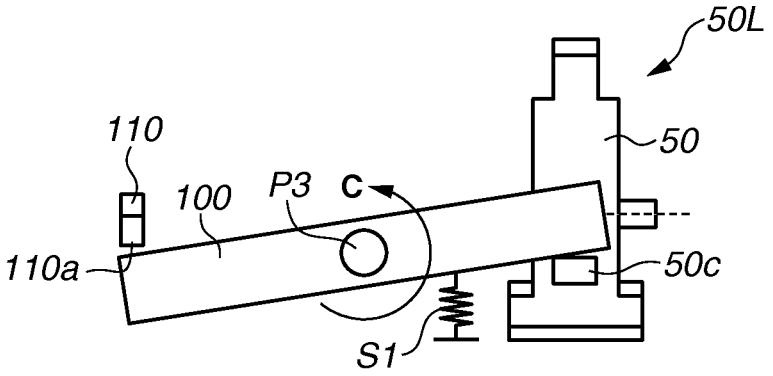

FIGS. 8A to 8C are top plan (conceptual) views illustrating first to third states of the main portion including the regulation member 100 illustrated in FIG. 4.

As illustrated in FIGS. 8A to 8C, when the regulation member 100 is moved to the regulation releasing position from the regulating position, the regulation member 100 is rotated (swung) in the rotation direction C by making the fulcrum P3 at the center.

More specifically, as illustrated in FIG. 8A, when the regulation member 100 is positioned at the regulating position, the second lever 50 is regulated at a position indicated by a dotted line and cannot move.

Further, as illustrated in FIG. 8B, when the regulation release member 110 moves upward (see FIG. 4), the regulation member 100 is rotated in the rotation direction C by a predetermined amount and moved to the regulation releasing position. At this time, although a rotational force in a direction opposite to the rotation direction C is applied to the regulation member 100 by an urging member S1, the movement of the regulation member 100 in that direction is prevented by the regulation release member 110. On the other hand, the second lever 50 can move because the regulation member 100 is located at a position (regulation releasing position) where the regulation member 100 does not regulate the second lever 50.

Further, as illustrated in FIG. 8C, when the second lever 50 is rotated (swung upward) by the user's operation, the abutting portion 50*c* is pressed against the regulation member 100. With this operation, the regulation member 100 is further moved in the rotation direction C. The regulation member 100 is rotated by the abutting portion 50*c* (operation lever unit 50L) up to a position (i.e., below-described regulation releasing position) separated from the regulation release member 110.

Figure 9A:
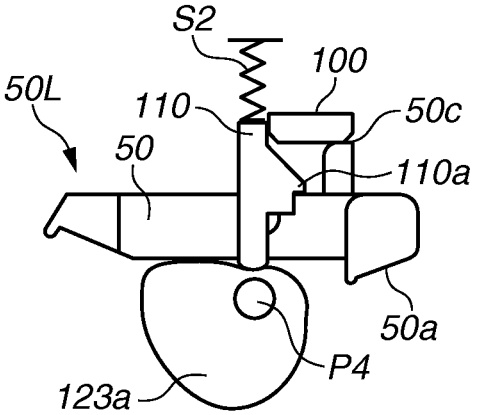
FIG. 9A is a side elevation view illustrating a first state of the main portion of the recording apparatus.

FIG. 9A is a side elevation (conceptual) view illustrating a first state of the main portion including the regulation member 100 illustrated in FIG. 4. The side elevation view in FIG. 9A corresponds to the top plan view in FIG. 8A, and illustrates a state where the regulation release member 110 is pressed against the cam 123*a* by an urging member S2.

Figure 9B:
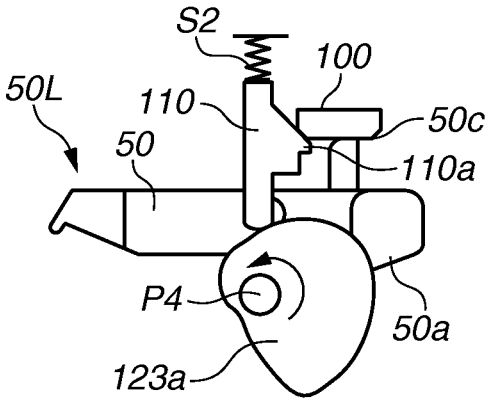
FIG. 9B is a side elevation view illustrating a state where the main portion of the recording apparatus start moving from the first state.

FIG. 9B is a side elevation (conceptual) view illustrating a state where the regulation release member 110 starts moving from the first state illustrated in FIG. 9A. The side elevation view in FIG. 9B illustrates a state where the cam 123*a* rotates and pushes the regulation release member 110 upward.

Figure 9C:
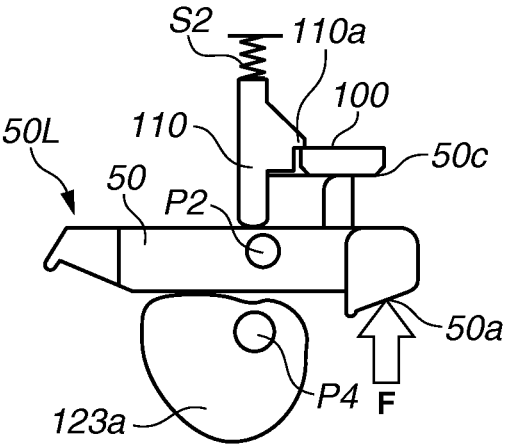
FIGS. 9C and 9D are side elevation views illustrating second and third states of the main portion of the recording apparatus.

FIG. 9C is a side elevation (conceptual) view illustrating a second state of the main portion including the regulation member 100 illustrated in FIG. 4. In addition, the side elevation view in FIG. 9C corresponds to the top plan view in FIG. 8B.

As illustrated in FIG. 9C or 8B, after the cam 123*a* has rotated by a 360-degree to push the regulation release member 110 upward, the regulation member 100 is located at the regulation releasing position where the regulation member 100 is held by the latching member 110*a* formed on the regulation release member 110 by making contact therewith. At this time, although a downward force is applied to the regulation release member 110 by the urging member S2, the regulation member 100 is held by the latching member 110*a* by making contact therewith.

In the above-described state, if force F is applied to the first end portion 50*a* of the second lever 50 by the user's operation, the second end portion 50*b* of the second lever 50 is moved to the second position. With this operation, the first lever 70 interlocking with the second lever 50 also swings, so that the engaged state thereof with respect to the ink cartridge 80 is released.

Figure 9D:
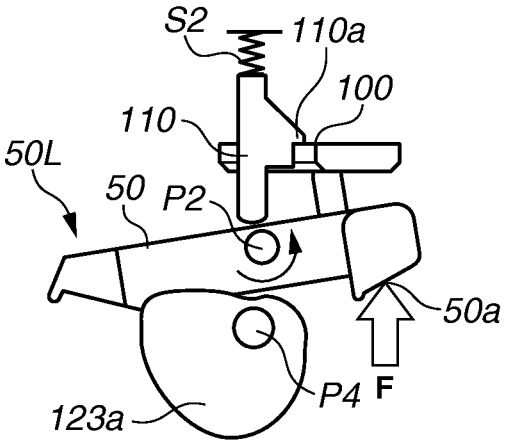

FIG. 9D is a side elevation (conceptual) view illustrating a third state of the main portion including the regulation member 100 illustrated in FIG. 4. In addition, the side elevation view in FIG. 9D corresponds to the top plan view in FIG. 8C.

As illustrated in FIG. 9D or 8C, when the second lever 50 further rotates (i.e., swings upward) about the fulcrum P2 to the third position from the second position, the regulation member 100 is further moved to the regulation releasing cancelling position in the rotation direction C. In other words, because the second lever 50 (latching unit) moves to the third position farther than the second position from the first position, the regulation member 100 can return to the regulating position after the engaged state is released securely.

In addition, the regulation member 100 moved to the regulation releasing cancelling position is separated from the latching member 110*a*. With this operation, the regulation release member 110 is pushed downward because of the urging force of the urging member S2. On the other hand, because the regulation release member 110 is moved (retreated) downward, the regulation member 100 returns to the regulating position because of the urging force of the urging member S1.

In other words, the operation lever unit 50L according to the present exemplary embodiment realizes a function of the return unit, and thus the operation lever unit 50L serves as the latching unit as well as the return unit. After the operation lever unit 50L (second lever 50) moves the regulation member 100 located at the regulation releasing position to the regulation releasing cancelling position, the regulation member 100 can eventually return to the regulating position.

In other words, in the recording apparatus 10 according to the present exemplary embodiment, the operation lever unit 50L (return unit) makes contact with the regulation member 100 that has been moved to the regulation releasing position in order to allow the operation lever unit 50L to move to the second position, so that the regulation member 100 can be returned to the regulating position from the regulation releasing position.

Further, in the present exemplary embodiment, in order to make the regulation member 100 return to the regulating position from the regulation releasing position, the operation lever unit 50L is simply moved to the third position, so that the regulation member 100 is moved to the regulation releasing cancelling position. In other words, the engaged state is released and the regulation member 100 is returned to the regulating position by executing the same operation.

Furthermore, in the present exemplary embodiment, by moving the operation lever unit 50L to the third position different from the first position and the second position, the regulation member 100 is moved to the regulation releasing cancelling position. However, the second position and the third position may be the same or approximately the same position. In other words, by moving the operation lever unit 50L (return unit) to the second position from the first position, the regulation member 100 can return to the regulating position from the regulation releasing position by making contact with the operation lever unit 50L.

Further, in the recording apparatus 10 according to the present exemplary embodiment, the regulation member 100 can be moved to the regulation releasing cancelling position where the regulation member 100 is allowed to return to the regulating position from the regulation releasing position, which is different from the regulating position or the regulation releasing position. In addition, the regulation member 100 can be returned to the regulating position after being moved to the regulation releasing cancelling position from the regulation releasing position by making contact with the operation lever unit 50L (return unit).

Further, the recording apparatus 10 according to the present exemplary embodiment is provided with the reciprocally movable carriage 5 on which the mounting portion A10 is mounted, and a regulation releasing position moving unit for moving the regulation member 100 to the regulation releasing position from the regulating position by using the driving force transmitted from the driving source. In the reciprocal movement direction B, the carriage 5 can move to a position where the driving force from the driving source is transmitted to the regulation releasing position moving unit and a position where the driving force from the driving source is not transmitted to the regulation releasing position moving unit. The regulation member 100 can be moved to the regulation releasing position from the regulating position according to the movement of the carriage 5.

Further, in the recording apparatus 10 according to the present exemplary embodiment, the driving source can be configured of a conveyance motor for conveying the recording medium.

Further, in the recording apparatus 10 according to the present exemplary embodiment, the release mechanism (i.e., regulation releasing position moving unit) can be provided with the driving force transmission portion 9 (connection member) which connects the release mechanism to the conveyance motor to make the release mechanism be driven thereby, and a retreat member that retreats the release mechanism from being connected to the conveyance motor in order not to make the release mechanism be driven thereby. Further, the retreat member may be configured of the carriage abutting portion 131, the pendulum abutting portion 132, or the trigger abutting plane 141.

In addition, the recording apparatus 10 according to the present exemplary embodiment may be provided with a detection unit for detecting a remaining ink amount within the ink cartridge 80. Further, the moving unit 9A may be controlled based on the information detected by the detection unit.

Figure 10:
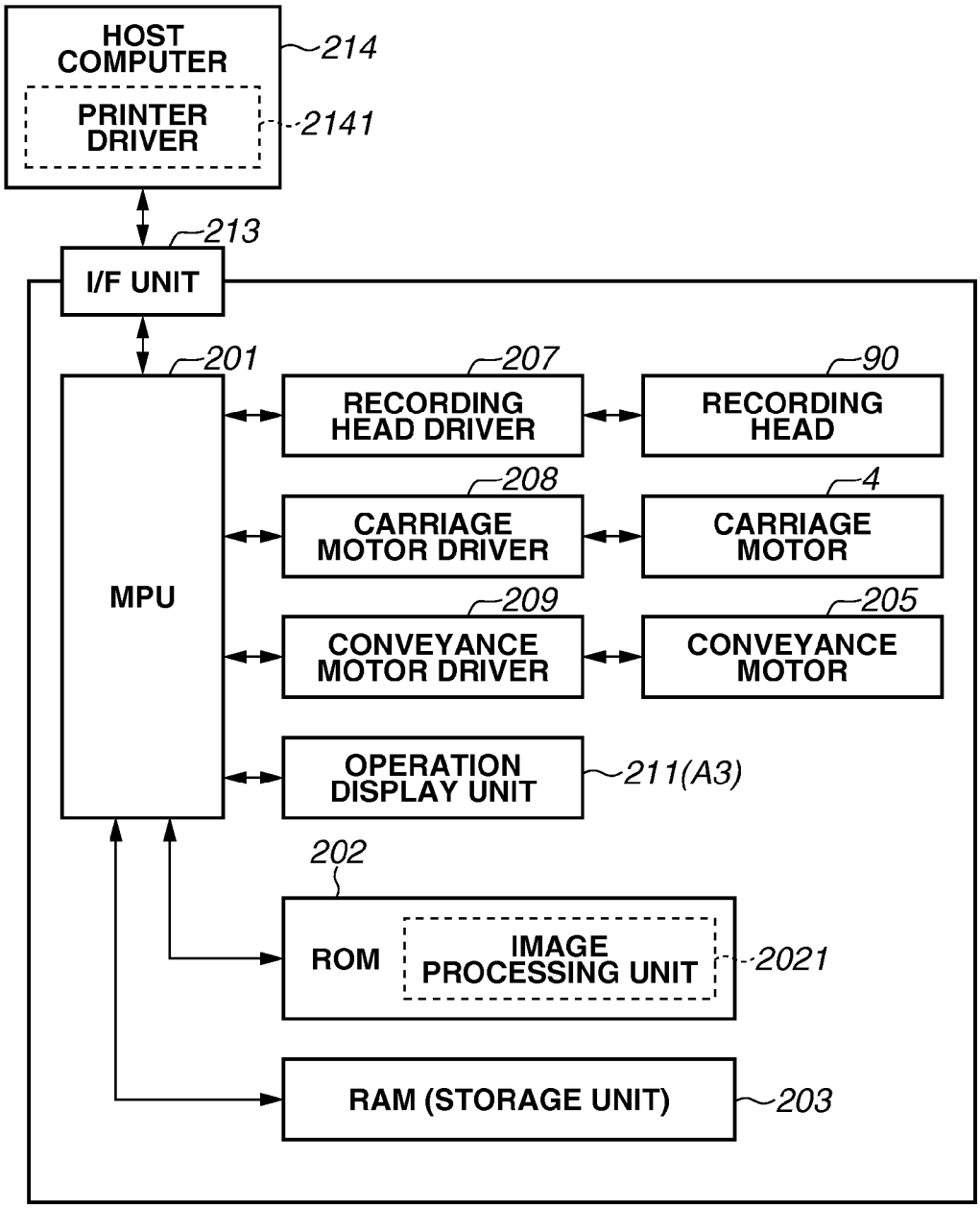
FIG. 10 is a block diagram illustrating a configuration of the recording apparatus.

FIG. 10 is a block diagram illustrating a configuration according to the present exemplary embodiment.

A micro processing unit (MPU) 201 controls operations of respective units and data processing. A read only memory (ROM) 202 stores data to be executed by the MPU 201. A random access memory (RAM) 203 temporarily stores processing data to be executed by the MPU 201 and the data received from a host computer 214. The recording head 90 is controlled by a recording head driver 207. The carriage motor 4 for driving the carriage 5 is controlled by a carriage motor driver 208. The conveyance roller 6 and the sheet discharge roller 7 are driven by a conveyance motor 205. The conveyance motor 205 is controlled by a conveyance motor driver 209. The MPU 201 outputs a clock signal based on the information such as a mode setting signal output from the operation input unit A3 and a display unit 211 or a detection signal transmitted from the remaining ink amount detection unit (not illustrated). The host computer 214 is provided with a printer driver 2141. In a case where execution of a printing operation is instructed by the user, the printer driver 2141 packs a recording image and recording information such as recording image quality, and communicates with the recording apparatus 10. The MPU 201 exchanges recording images and the like with the host computer 214 via an interface (I/F) unit 213. When printing data is transmitted from the host computer 214 via the I/F unit 213, the printing data is processed by the MPU 201 and rasterized on the RAM 203, so that a recording operation is started based on the rasterized data.

Figure 11:
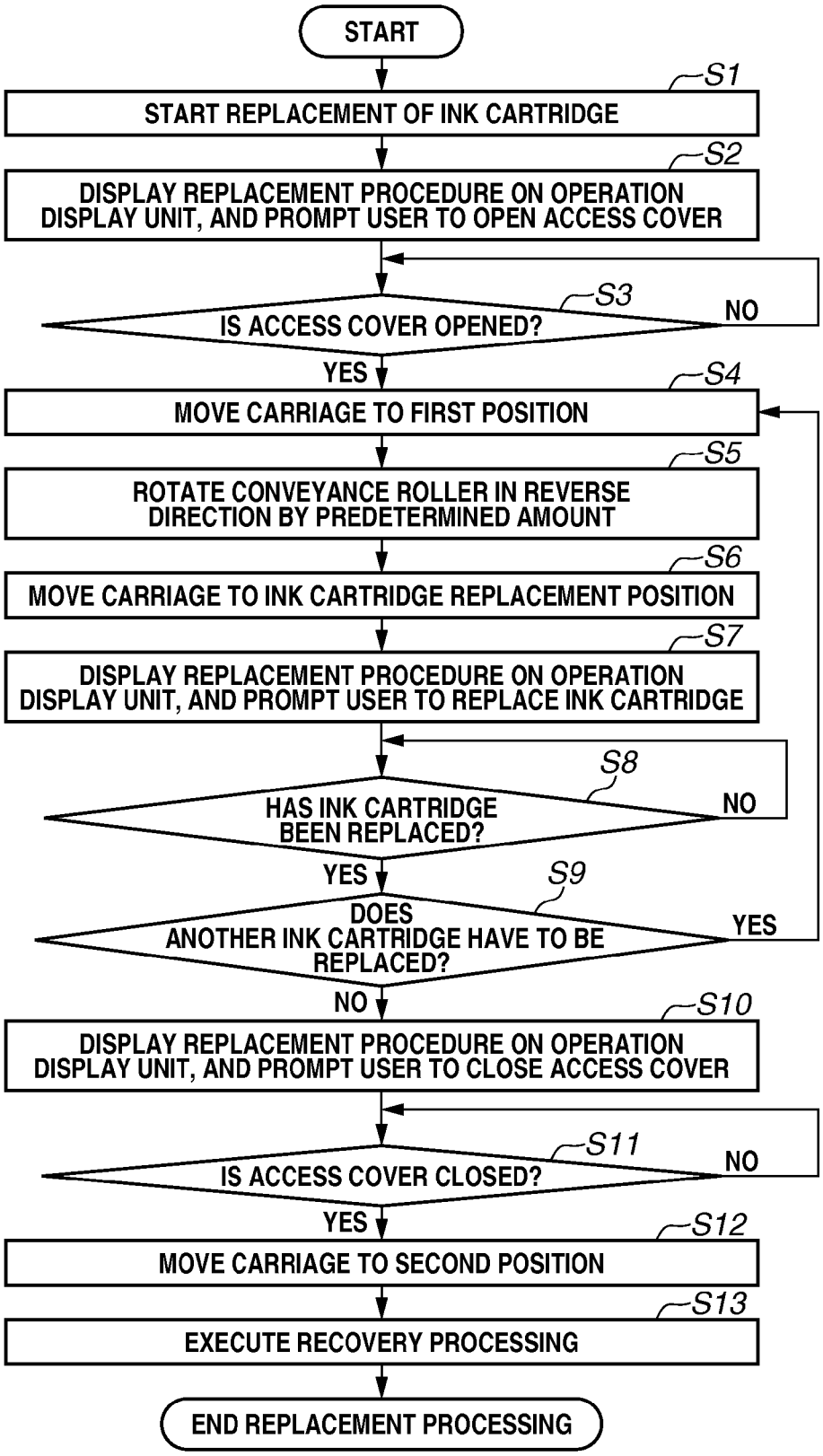
FIG. 11 is a flowchart illustrating an operation executed by the recording apparatus.

Next, a series of operations for replacing an ink cartridge 80 according to the present exemplary embodiment will be described with reference to FIG. 11.

In step S1, the MPU 201 outputs a replacement start signal of the ink cartridge 80.

By outputting the replacement start signal, the MPU 201 causes the operation input unit A3 and the display unit 211 to display a screen for notifying the user that the ink cartridge 80 has to be replaced. In step S2, the MPU 201 further displays a replacement procedure of the ink cartridge 80 on the screen, and prompts the user to open the access cover 20.

In step S3, the MPU 201 displays the replacement procedure of the ink cartridge 80 on the screen until the MPU 201 detects that the access cover 20 is opened.

When the MPU 201 detects that the access cover 20 is opened (YES in step S3), the processing proceeds to step S4. In step S4, the carriage motor driver 208 controls the carriage motor 4 to move the recording head 90 to the first position illustrated in FIG. 5B.

After the recording head 90 is moved to the first position, then in step S5, the conveyance motor driver 209 controls the conveyance motor 205 to rotate the conveyance roller 6 in a reverse rotation direction by a predetermined amount.

Through the above-described processing performed in step S5, the driving force is transmitted up to the gear 123, so that the regulation member 100 is moved to the regulation releasing position from the regulating position. The above-described "predetermined amount" is a sufficient amount with which the regulation member 100 can move to the position illustrated in FIG. 9C. Then, in step S6, the conveyance motor driver 209 controls the conveyance motor 205 to move the replacement-target ink cartridge 80 to the replacement position illustrated in FIG. 5C.

Then, in step S7, the MPU 201 causes the operation input unit A3 and the display unit 211 to display a screen for notifying the user that the preparation for replacing the ink cartridge 80 is ready, and prompts the user to replace the ink cartridge 80.

Next, in step S8, the MPU 201 determines whether the ink cartridge 80 is replaced.

If the ink cartridge 80 is replaced (YES in step S8), the processing proceeds to step S9. In step S9, the MPU 201 determines whether another ink cartridge 80 has to be also replaced. If another ink cartridge 80 has to be replaced (YES in step S9), the processing returns to step S4, and the MPU 201 similarly repeats the processing of steps S4 to S9 in order to replace another ink cartridge 80.

If another ink cartridge 80 does not have to be replaced (NO in step S9), the processing proceeds to step S10. In step S10, the MPU 201 prompts the user to close the access cover 20.

In step S11, the MPU 201 displays a message prompting the user to close the access cover 20 on the screen until the MPU 201 detects that the access cover 20 is closed.

If the MPU 201 detects that the access cover 20 is closed (YES in step S11), the processing proceeds to step S12. In step S12, the carriage motor driver 208 controls the carriage motor 4 to move the recording head 90 to the second position illustrated in FIG. 5A.

Thereafter, in step S13, the MPU 201 executes recovery processing.

As described above, when the ink cartridge 80 is replaced, ink is consumed by executing the recovery processing. Accordingly, the more frequently the ink cartridge is mounted or removed, the more the ink is consumed. However, according to the recording apparatus 10 described in the present exemplary embodiment, once the user pushes the operation lever unit 50L to remove the ink cartridge 80, the operation lever unit 50L is regulated by the regulation member 100 not to rotate. Therefore, the ink cartridge 80 cannot be removed unless the ink within the ink cartridge 80 is used up and the ink cartridge 80 has to be replaced. With this configuration, the ink cartridge 80 is prevented from being removed by the careless operation or the erroneous operation of the user, and the replacement frequency of the ink cartridge 80 and the amount of ink consumed by the recovery processing at the replacement can be reduced to a requisite minimum.

Further, because the ink cartridge 80 can be prevented from being replaced by the unnecessary operation, unused ink left within the ink cartridge 80 can be minimized, and the ink wastefully consumed by the maintenance work caused by the unnecessary replacing of the ink cartridge 80 can be minimized. Therefore, when the ink cartridge 80 is replaced, the ink cartridge 80 can be replaced appropriately while minimizing the waste, so that the efficiency and the usability can be improved.

Hereinafter, the recording apparatus 10 according to a variation of the first exemplary embodiment of the present invention will be described with reference to FIGS. 12A and 12B.

The present exemplary embodiment is basically the same as the first exemplary embodiment, and thus differences will be mainly described below.

Figure 12A:
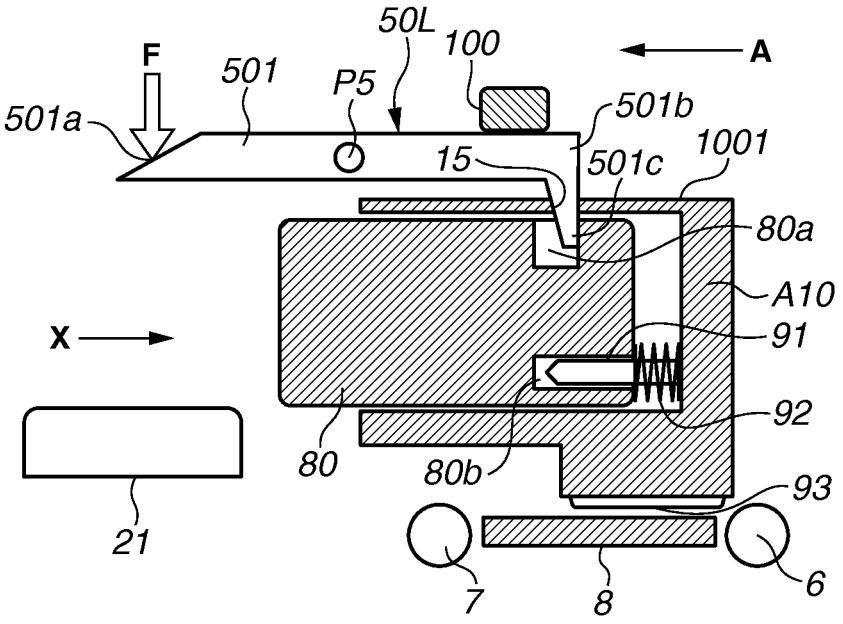
FIG. 12A is a cross-sectional view illustrating a state where an ink cartridge of a recording apparatus according to a variation of the first exemplary embodiment is mounted.

FIG. 12A is a cross-sectional (conceptual) view illustrating a state where the ink cartridge 80 is mounted. FIG. 12B is a cross-sectional (conceptual) view illustrating a state where the ink cartridge 80 is released from the mounted state. FIGS. 12A and 12B are vertical cross-sectional views seen in the direction Z in FIG. 2 when the ink cartridge 80 moves to a position opposing the guiding member 21.

Figure 12B:
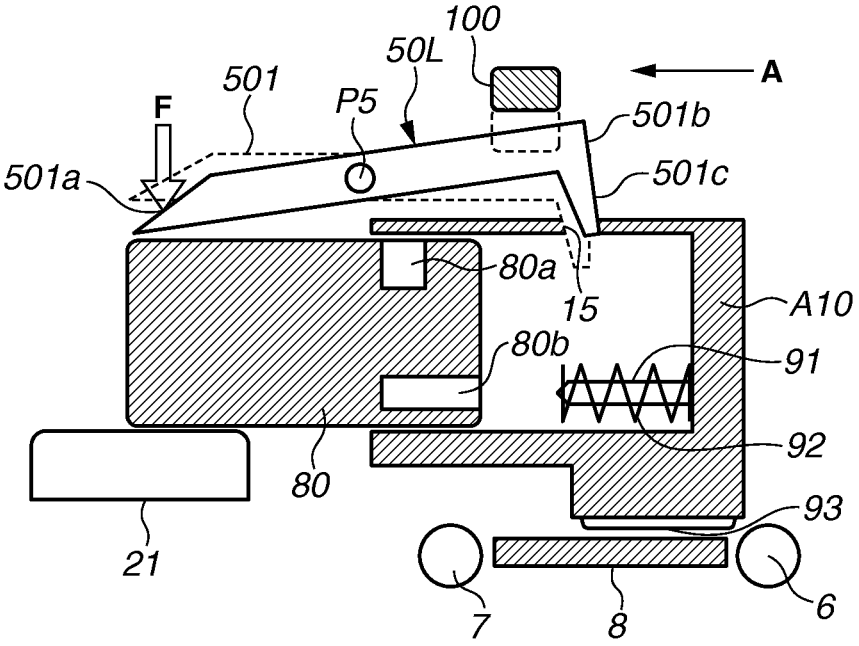
FIG. 12B is a cross-sectional view illustrating a state where the ink cartridge is released from the mounted state.

As illustrated in FIGS. 12A and 12B, an operation lever unit 50L according to the present exemplary embodiment is configured of only a lever 501.

The lever 501 is provided with a first end portion 501*a* and a second end portion 501*b*, and attached to the upper face portion 1001 of the mounting portion A10 so as to be swingable about a fulcrum P5. In addition, the lever 501 may be attached to the housing A1.

Further, a latching projection 501*c* is provided on the second end portion 501*b* of the lever 501. Similar to the latching projection 70*c* described in the first exemplary embodiment, the latching projection 501*c* passes through the through hole 15 provided in the mounting portion A10 (upper face portion 1001) and enters into the engagement depressed portion 80*a* of the ink cartridge 80 to form an engaged (latched) state at the first position. In addition, similar to the first exemplary embodiment, the lever 501 is further provided with an urging spring (not illustrated), so that the latching projection 501*c* is constantly urged downward.

When the user operates (presses down) the first end portion 501*a* of the lever 501, the second end portion 501*b* (latching projection 501*c*) is moved upward, so that the engagement relationship between the engagement depressed portion 80*a* (ink cartridge 80) and the latching projection 501*c* (operation lever unit 50L) can be released.

On the other hand, the regulation member 100 for regulating the movement of the operation lever unit 50L is provided on the housing A1 on the upper side of the second end portion 501*b* of the lever 501. As illustrated in FIG. 12B, when the regulation member 100 is moved to the regulation releasing position (indicated by a solid line) from the regulating position (indicated by a dotted line), the regulated state of the operation lever unit 50L can be released. Further, when the regulation member 100 returns to the regulating position from the regulation releasing position, the operation lever unit 50L can return to the regulated state again.

In the present exemplary embodiment, the regulation member 100 is arranged on the upper side of the second end portion 501*b* of the lever 501. However, the regulation member 100 may be arranged on the lower side of the first end portion 501*a* of the lever 501. In other words, similar to the first exemplary embodiment, the regulation member 100 may be arranged at another position as long as the regulation member 100 can counteract the user's operation acting in the operation direction F.

Further, the operation lever unit 50L (lever 501) may be configured to be swingable about the fulcrum P5. In such a case, it is preferable that the first position (latching position), the second position (latch releasing position), and the third position (regulation releasing cancelling position) be arranged on an arc having the fulcrum P5 at the center.

Furthermore, the second position may be arranged at a position between the first position and the third position.

Hereinafter, the recording apparatus 10 according to a second exemplary embodiment of the present invention will be described with reference to FIG. 13 and FIGS. 14A to 14F.

The present exemplary embodiment is basically the same as the first exemplary embodiment, and thus differences will be mainly described below.

Figure 13:
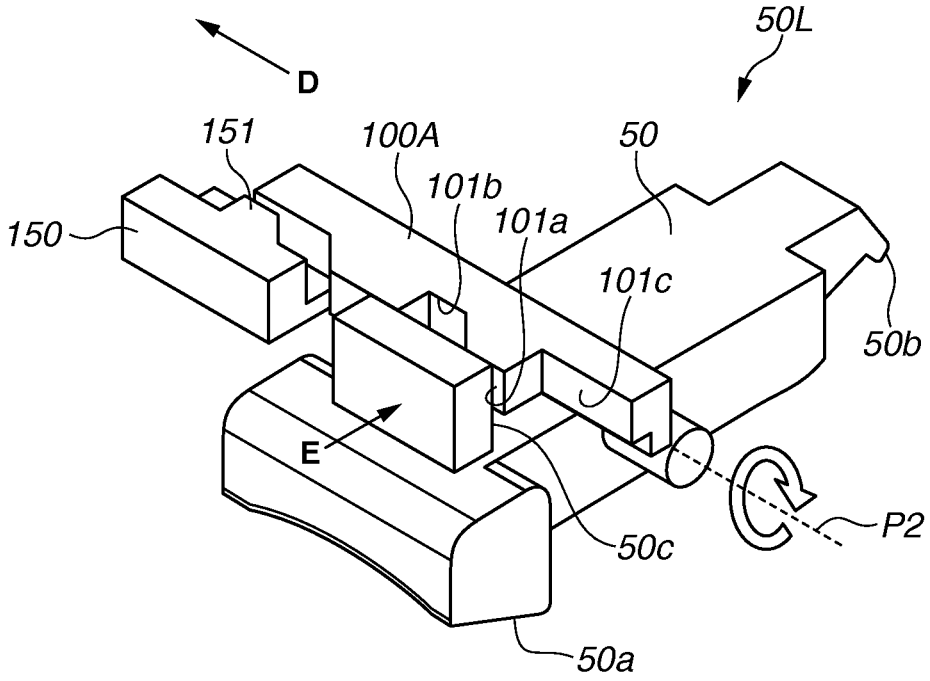
FIG. 13 is a perspective view illustrating a main portion of a recording apparatus according to a second exemplary embodiment of the present invention.

FIG. 13 is a perspective (conceptual) view of the main portion including a regulation member 100A of the recording apparatus 10 according to the present exemplary embodiment. FIGS. 14A to 14F are top plan (conceptual) views illustrating first to sixth states of the main portion including the regulation member 100A illustrated in FIG. 13.

As illustrated in FIG. 13 and FIGS. 14A to 14F, the regulation member 100A is arranged on the upper side of the second lever 50 so as to be capable of contacting the abutting portion 50*c* formed on the upper face of the second lever 50.

More specifically, the regulation member 100A is attached to the housing A1 so as to be horizontally movable in a direction D (or opposite direction). The regulation member 100A is moved in a direction D by receiving the driving force from the driving source (e.g., conveyance motor) through the above-described driving force transmission portion 9 (see FIG. 2) serving as the regulation releasing position moving unit and the moving unit 9A (see FIG. 4). The direction D (or the opposite direction) may be the same direction as the scanning direction B.

Figure 14A:
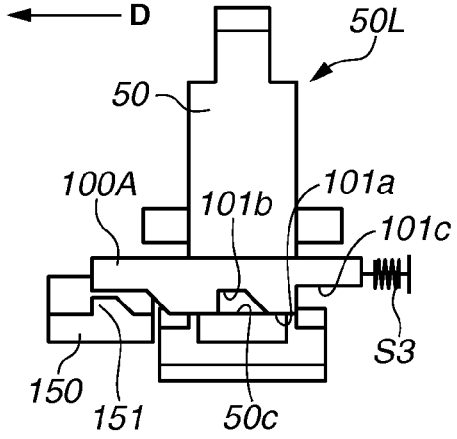
FIGS. 14A to 14F are top plan views illustrating first to sixth states of the main portion of the recording apparatus.

Further, the regulation member 100A includes a regulation end surface 101*a* capable of contacting the abutting portion 50*c*, a groove portion 101*b*, and an abutting surface 101*c*. Further, the regulation end surface 101*a* is urged to position at a position contacting (abutting to) the abutting portion 50*c* by an urging member S3, so that the movement of the abutting portion 50*c* in a direction E is regulated by the regulation end surface 101*a*. In other words, as illustrated in FIG. 14A, in the normal state, the regulation member 100A is positioned at the regulating position by the urging member S3, and the swing (rotation) of the second lever 50 about the fulcrum P2 in the upward direction is regulated thereby.

Figure 14B:
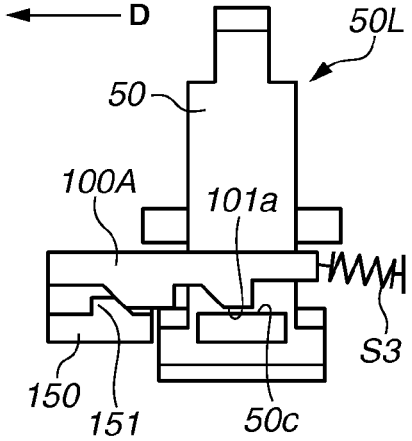
Figure 14C:
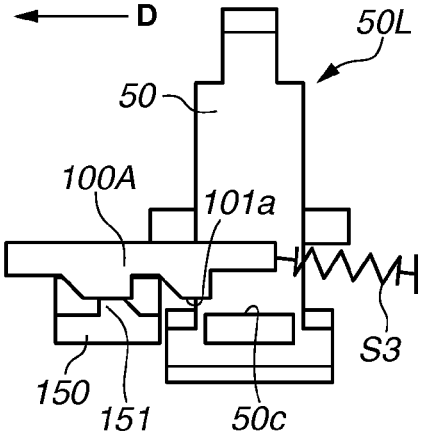
Figure 14D:
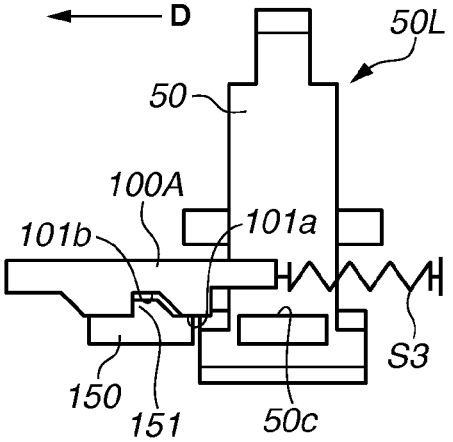

On the other hand, as illustrated in FIGS. 14B to 14D, when the regulation member 100A is moved in the direction D by the driving force transmission portion 9 and the moving unit 9A, the regulation end surface 101*a* is moved to the regulation releasing position from the regulating position. Because the regulation end surface 101*a* is retreated, the abutting portion 50*c* is allowed to move in the direction E (see FIG. 13). Further, because the groove portion 101*b* engages with a projection portion 151 of a fixing portion 150 formed on the housing A1, the regulation member 100A (regulation end surface 101*a*) is held at the regulation releasing position against the urging force of the urging member S3.

As described above, according to the present exemplary embodiment, similar to the first exemplary embodiment, when the regulation member 100A is located at the regulating position, the movement of the second lever about the fulcrum P2 in the upward direction is regulated thereby, and thus the first lever 70 (latching projection 70*c*) interlocking with the second lever 50 is maintained (locked) at the first position in the engaged state. Therefore, the operation lever unit 50L that latches the ink cartridge 80 is set to be a regulated state, so that the engaged (mounted) state will not be released by the careless operation of the user.

On the other hand, similar to the first exemplary embodiment, when the regulated state of the operation lever unit 50L has to be released, the regulation member 100A is moved to the regulation releasing position from the regulating position by the regulation releasing position moving unit, so that the regulated state thereof can be released.

Further, according to the present exemplary embodiment, similar to the first exemplary embodiment, the regulation member 100A that is moved to the regulation releasing position can be returned to the regulating position from the regulation releasing position by the return unit. In the present exemplary embodiment, the return unit is configured of the operation lever unit 50L (second lever 50). In other words, according to the present exemplary embodiment, the operation lever unit 50L serves as the latching unit as well as the return unit according to the present invention.

Figure 14E:
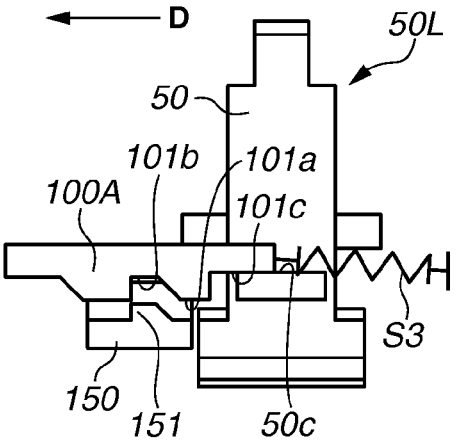
Figure 14F:
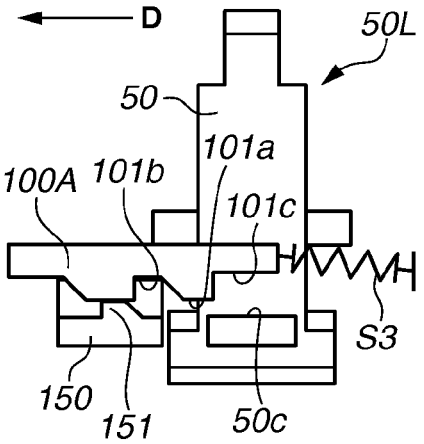

More specifically, as illustrated in FIGS. 14E and 14F, the operation lever unit 50L (second lever 50) is swung about the fulcrum P2, so that the regulation member 100A can be moved in the direction E. In other words, the abutting surface 101*c* of the regulation member 100A is pressed by the abutting portion 50*c* of the second lever 50, so that the regulation member 100A is relatively moved (i.e. separated) from the fixing portion 150. As a result, the projection portion 151 is separated from the groove portion 101*b* of the regulation member 100A, so that the engagement relationship thereof is released. Therefore, the regulation member 100A is returned to the regulating position by the urging force of the urging member S3.

Hereinafter, the recording apparatus 10 according to a variation of the second exemplary embodiment of the present invention will be described with reference to FIGS. 15 to 17F.

The present exemplary embodiment is basically the same as the second exemplary embodiment, and thus differences will be mainly described below.

Figure 15:
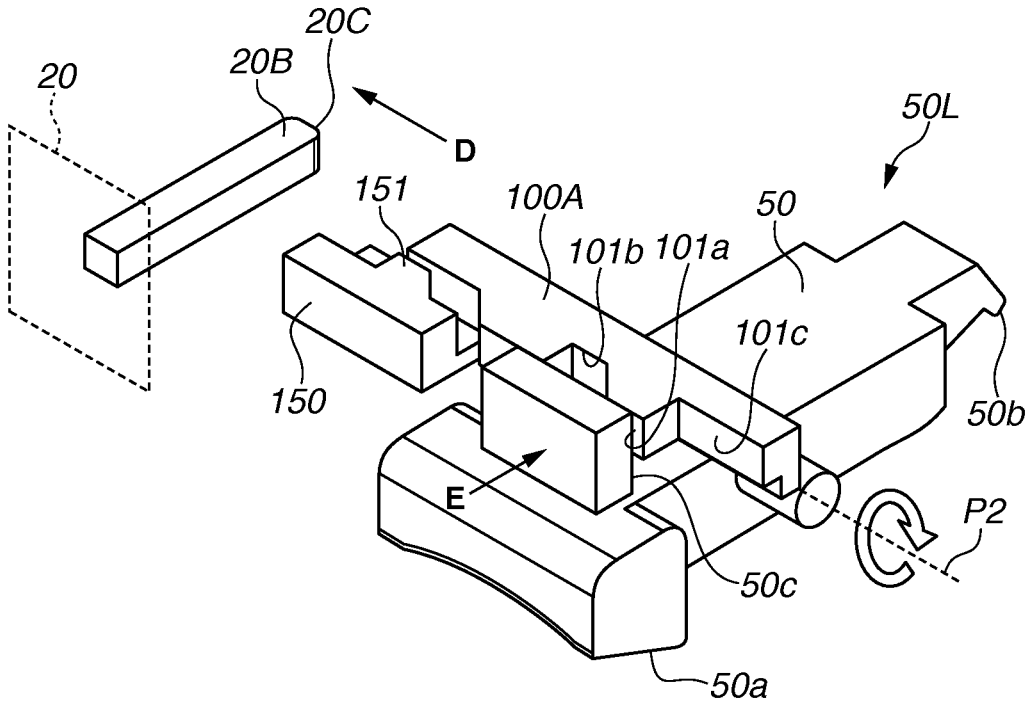
FIG. 15 is a perspective view of a main portion of a recording apparatus according to a variation of the second exemplary embodiment.

FIG. 15 is a perspective (conceptual) view of the main portion including the regulation member 100A of the recording apparatus 10 according to the present exemplary embodiment.

Figure 16A:
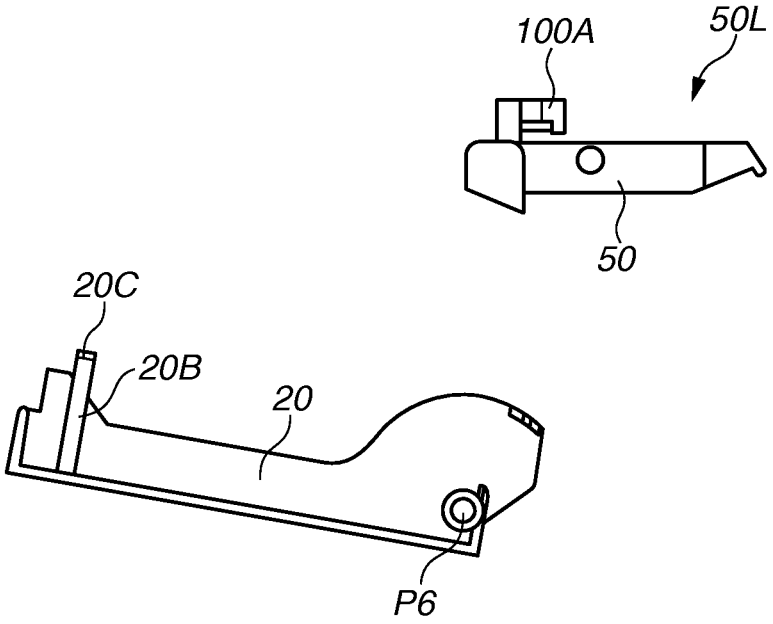
FIG. 16A is a cross-sectional view of the main portion illustrating a state where an access cover of the recording apparatus is opened.
Figure 16B:
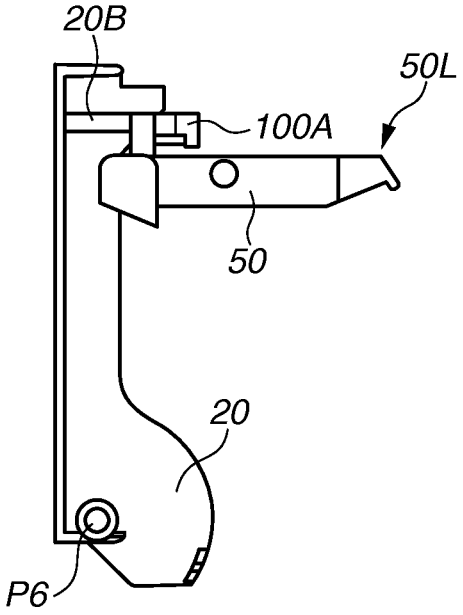
FIG. 16B is a cross-sectional view of the main portion illustrating a state where the access cover of the recording apparatus is closed.

FIG. 16A is a vertical cross-sectional (conceptual) view illustrating a state where the access cover 20 of the recording apparatus 10 is opened. FIG. 16B is a vertical cross-sectional (conceptual) view illustrating a state where the access cover 20 is closed.

FIGS. 17A to 17F are top plan (conceptual) views illustrating first to sixth states of the main portion including the regulation member 100A illustrated in FIG. 15.

Similar to the above-described first and the second exemplary embodiments, in the present exemplary embodiment, the access cover 20 is attached to the housing A1 so as to be relatively movable with respect to the operation lever unit 50L. More specifically, the access cover 20 is attached to the housing A1 in a rotatable state through a rotation shaft P6 provided on the lower portion thereof.

Further, as illustrated in FIG. 16A, a projection portion 20B is provided on the access cover 20. More specifically, the projection portion 20B is arranged on one surface of the access cover 20 facing the inner portion of the housing A1 so as to be projected toward the interior thereof, and an abutting portion 20C is provided on a leading end thereof. When the access cover 20 is opened, the projection portion 20B is arranged at a position where the abutting portion 20B does not contact the regulation member 100A. In such a state, if the regulation member 100A is located at the regulating position, the operation lever unit 50L (latching unit) is regulated and cannot move (swing).

As illustrated in FIG. 16B, when the access cover 20 is closed, the abutting portion 20C of the projection portion 20B is arranged at a position where the abutting portion 20*c* can contact the regulation member 100A positioned on the upper side of the second lever 50.

Figure 17A:
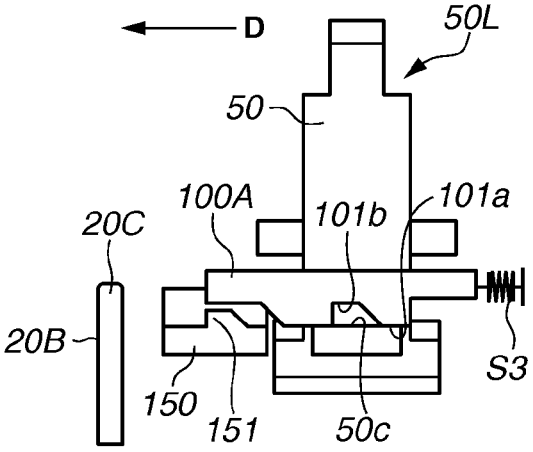
FIGS. 17A to 17F are top plan views illustrating first to sixth states of the main portion of the recording apparatus.
Figure 17B:
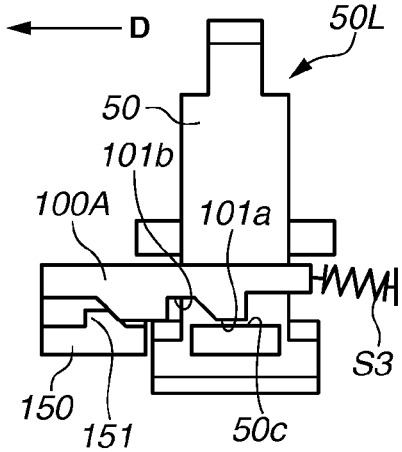
Figure 17C:
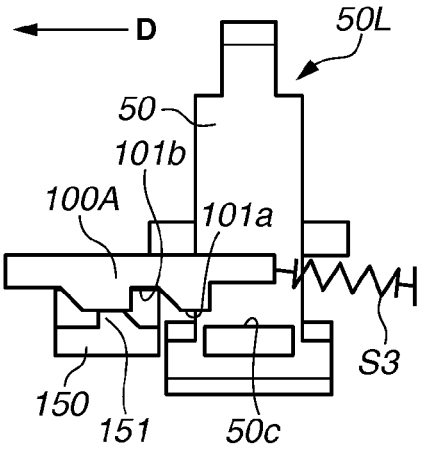
Figure 17D:
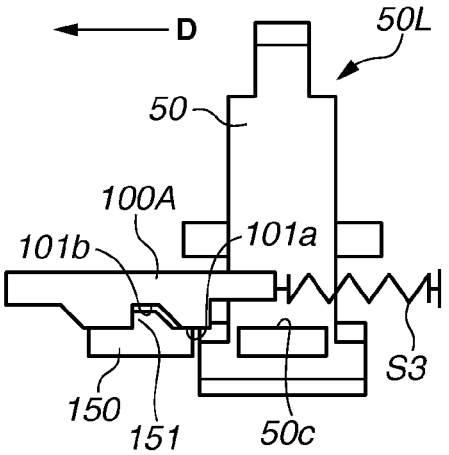

Similar to FIGS. 14A to 14D described in the second exemplary embodiment, FIGS. 17A to 17D are diagrams illustrating positional relationships between the regulation member 100A and the operation lever unit 50L. As illustrated in FIG. 17A, the projection portion 20B does not contact the regulation member 100A even if the access cover 20 is closed.

Figure 17E:
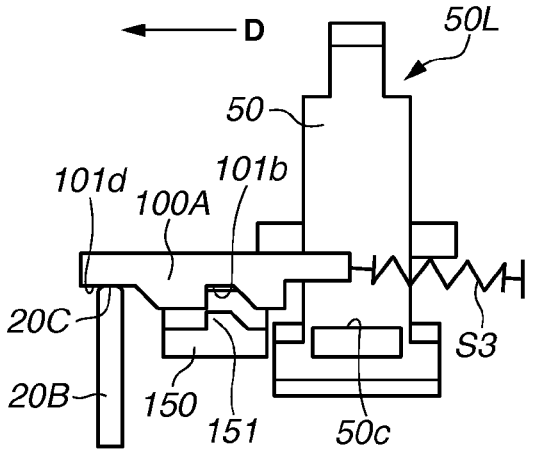
Figure 17F:
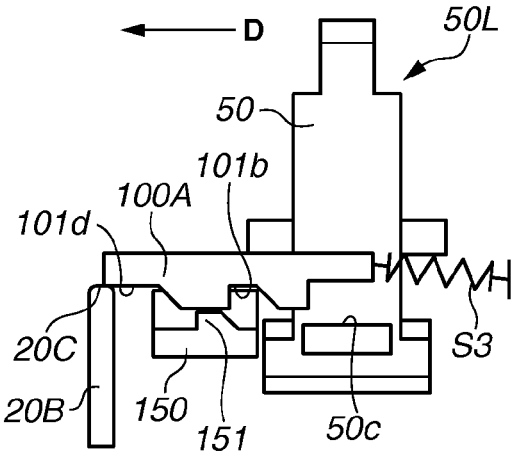

On the other hand, as illustrated in FIGS. 17E and 17F, if the access cover 20 is closed after the regulation member 100A is moved to the regulation releasing position from the regulating position by the regulation releasing position moving unit, the projection portion 20B contacts the abutting surface 101*d* of the regulation member 100A.

With this configuration, the abutting surface 101*d* of the regulation member 100A is pressed by the projection portion 20B, so that the regulation member 100A is relatively moved (separated) from the fixing portion 150. Therefore, the regulation member 100A can be moved in the direction E interlocking with the operation for closing the access cover 20. As a result, the projection portion 151 is separated from the groove portion 101*b* of the regulation member 100A, so that the engagement relationship thereof is released. Further, the regulation member 100A is returned to the regulating position from the regulation releasing position by the urging force of the urging member S3. In other words, the return unit according to the present invention is configured of the projection portion 20B according to the present exemplary embodiment.

Further, the return unit (projection portion 20B) according to the present exemplary embodiment may be changed appropriately and applied to the first exemplary embodiment. For example, the abutting surface 20C of the projection portion 20B may be brought into contact with a side surface of the regulation member 100 in FIGS. 8A to 8C, so that the regulation member 100 is rotated about the fulcrum P3 in the rotation direction C and moved from the regulation releasing position in FIG. 8B to the regulation releasing cancelling position in FIG. 8C to return to the regulating position from the regulation releasing position.

As described above, the return unit (projection portion 20B) according to the present exemplary embodiment is fixed to the access cover 20 serving as a movable member relatively movable with respect to the regulation member 100A, and provided with the abutting portion 20C capable of contacting the regulation member 100A. Furthermore, due to the movement of the abutting portion 20C interlocking with the movable member (access cover 20), the regulation member 100A can return to the regulating position from the regulation releasing position.

According to the recording apparatus described in the present exemplary embodiment, by providing the regulation member, the latching unit is less likely to be operated carelessly. Further, even in a case where the regulation member is operated carelessly and moved to the regulation releasing position from the regulating position, the regulation member can be easily returned to the regulating position by the return unit. As a result, the latching unit is regulated again by the regulation member that has been returned to the regulating position, so that the ink cartridge can be prevented from being removed from the mounting portion because of the careless operation executed on the latching unit.

Accordingly, the user can remove and mount (replace) the ink cartridge only when necessary, and thus the ink cartridge is prevented from being removed by the careless operation. With this configuration, the usability thereof can be improved.

Further, it is possible to minimize the unused ink left within the ink cartridge caused by the removing and mounting operations of the ink cartridge. In other words, it is possible to prevent a situation in which the ink cartridge is removed from the mounting portion because of the careless operation and the usable ink cartridge is replaced with new one, because the user cannot judge the remaining ink amount correctly. Thus, it is possible to avoid the problem of wasteful work and wasteful ink consumption resulting from the above-described situation.

Further, it is possible to minimize the ink wastefully consumed by the maintenance work associated with the mounting-removing operation of the ink cartridge. Therefore, it is possible to save the effort for executing a suction operation (i.e., maintenance operation) for suctioning the ink within an ink flow channel, which is to be executed in order to eliminate the air (bubbles) mixing into the ink flow channel because of the careless removing and mounting operations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170983, filed Aug. 25, 2014, which is hereby incorporated by reference herein in its entirety.

What is claimed is:

1. A recording apparatus comprising:

a recording head configured to execute recording on a recording medium;

a mounting portion on which an ink cartridge for supplying ink to the recording head is mounted;

a latching unit configured to be changeable between a first state where the ink cartridge mounted on the mounting portion is latched and a second state where the ink cartridge mounted on the mounting portion is not latched;

a regulation member configured to be movable between a regulating position where the regulation member regulates movement of the latching unit and a releasing position where the regulation member allows the movement of the latching unit; and a return unit configured to return the regulation member to the regulating position from the releasing position by contacting the regulation member moved to the releasing position.

2. The recording apparatus according to claim 1, wherein the return unit includes the latching unit, wherein the latching unit can change to a third state, which is different from the first state and the second state, where the latching unit can contact the regulation member, wherein, the latching unit changes to the third state so that the regulation member returns to the regulating position from the releasing position by contacting the latching unit.

3. The recording apparatus according to claim 2, wherein the regulation member can move to a cancelling position, which is different from the regulating position or the releasing position, where the regulation member is allowed to return to the regulating position from the releasing position, and wherein the regulation member returns to the regulating position after the regulation member is moved to the cancelling position from the releasing position by contacting the latching unit.

4. The recording apparatus according to claim 3, wherein the latching unit is configured to be swingable about a predetermined fulcrum.

5. The recording apparatus according to claim 1, wherein the return unit includes an abutting portion fixed to a movable member movable relatively to the regulation member and capable of contacting the regulation member, and wherein the regulation member returns to the regulating position from the releasing position according to movement of the abutting portion interlocking with movement of the movable member.

6. The recording apparatus according to claim 5, further comprising:

a housing configured to house the mounting portion;

an opening portion provided on the housing, through which an ink cartridge can be mounted on or removed from the mounting portion housed within the housing; and a cover, provided on the housing, configured to open and close the opening, wherein the movable member is configured of the cover, and wherein the abutting portion is arranged on the cover.

7. The recording apparatus according to claim 1, further comprising:

a carriage, on which the mounting portion is mounted, configured to be movable in a reciprocal movement direction; and a moving unit configured to move the regulation member to the releasing position from the regulating position by using driving force transmitted from a driving source, wherein the carriage can move between a position where the driving force from the driving source is transmitted to the moving unit and a position where the driving force from the driving source is not transmitted to the moving unit in the reciprocal movement direction.

8. The recording apparatus according to claim 7, wherein the driving source includes a conveyance motor configured to convey the recording medium.

9. The recording apparatus according to claim 8, wherein the moving unit includes a connection unit configured to connect the moving unit to the conveyance motor in order to make the moving unit be driven by the conveyance motor, and a disconnection unit configured to disconnect the moving unit from the conveyance motor in order prevent the moving unit from being driven by the conveyance motor.

10. The recording apparatus according to claim 7, further comprising a detection unit configured to detect a remaining ink amount within the ink cartridge;

wherein the moving unit is controlled based on information detected by the detection unit.

11. The recording apparatus according to claim 1, wherein the latching unit is changed to the second state from the first state by an external force applied to the latching unit.

12. A recording apparatus comprising:

a recording head configured to execute recording on a recording medium;

a mounting portion on which an ink cartridge for supplying ink to the recording head is mounted;

a latching member configured to be movable between a first position where the ink cartridge mounted on the mounting portion is latched and a second position where the ink cartridge mounted on the mounting portion is not latched;

an operating member configured to be operated by a user, wherein the latching member is moved from the first position to the second position when the operating member is operated;

a regulation member configured to be movable between a regulating position where the regulation member regulates movement of the operating member and a releasing position where the regulation member allows the movement of the operating member, wherein the regulation member is moved from the releasing position to the regulating position when the operation member is operated.

13. The recording apparatus according to claim 12, wherein the ink cartridge is separated from the mounting portion when the latching member is moved from the first position to the second position.

14. The recording apparatus according to claim 12, wherein the operating member is provided with an abutting portion, wherein the regulation member is moved to the regulating position when the abutting portion abuts to the regulation member.

15. The recording apparatus according to claim 12, wherein, the latching member includes a first lever that is swingable about a first fulcrum, and the operating member includes a second lever that is swingable about a second fulcrum.

16. The recording apparatus according to claim 12, wherein, the ink cartridge has an depressed portion and the latching member has an engage portion that engages to the depressed portion, and the ink cartridge is latched to the mounting portion when the engaging portion engages to the depressed portion.

17. A recording apparatus comprising:

a recording head configured to execute recording on a recording medium;

a carriage, having a mounting portion in which an ink cartridge for the recording head is mounted, configured to reciprocate in a reciprocal movement direction;

a latching unit configured to be changeable between a first state where the ink cartridge mounted on the mounting portion is latched and a second state where the ink cartridge mounted on the mounting portion is not latched; and a regulation member configured to be movable between a regulating position where the regulation member regulates movement of the latching unit and a releasing position where the regulation member allows the movement of the latching unit;

a moving unit configured to move the regulation member from the regulating position to the releasing position;

wherein after the carriage is moved to a predetermined position, the regulation member is moved to the releasing position by the moving unit.

18. The recording apparatus according to claim 17, wherein, the predetermined position is a position where the driving force from the driving source is able to transmit to the moving unit, and the moving unit moves the regulation member by using driving force transmitted from a driving source.

19. The recording apparatus according to claim 18, wherein the driving source includes a conveyance motor for conveying the recording medium.

20. The recording apparatus according to claim 19, wherein the moving unit includes a connection unit configured to connect the moving unit to the conveyance motor in order to make the moving unit be driven by the conveyance motor, and a disconnection unit configured to disconnect the moving unit from the conveyance motor in order prevent the moving unit from being driven by the conveyance motor.

* * * * *